US010633871B2

(12) United States Patent
Murray

(10) Patent No.: US 10,633,871 B2
(45) Date of Patent: Apr. 28, 2020

(54) SYSTEM FOR APPLYING FINISHING COMPOUND

(71) Applicant: Level 5 Tools, LLC, Kansas City, KS (US)

(72) Inventor: Scott Murray, Kansas City, KS (US)

(73) Assignee: Level 5 Tools, LLC, Kansas City, KS (US)

( * ) Notice: Subject to any disclaimer, the term of this patent is extended or adjusted under 35 U.S.C. 154(b) by 133 days.

(21) Appl. No.: 15/721,601

(22) Filed: Sep. 29, 2017

(65) Prior Publication Data

US 2018/0087281 A1 Mar. 29, 2018

Related U.S. Application Data

(60) Provisional application No. 62/401,579, filed on Sep. 29, 2016.

(51) Int. Cl.

| | |
|---|---|
| ***E04F 21/165*** | (2006.01) |
| ***E04F 21/06*** | (2006.01) |
| ***E04F 21/08*** | (2006.01) |
| ***B05C 17/00*** | (2006.01) |
| ***B05C 17/01*** | (2006.01) |

(52) U.S. Cl.

CPC ..... *E04F 21/1655* (2013.01); *B05C 17/002* (2013.01); *B05C 17/003* (2013.01); *B05C 17/0103* (2013.01); *E04F 21/06* (2013.01); *E04F 21/08* (2013.01)

(58) Field of Classification Search

CPC ..... E04F 21/20; E04F 21/12; E04F 21/1655; E04F 21/06; E04F 21/10; E04F 21/08; E04F 21/085; E04F 21/16; E04F 21/161; E04F 21/165; B05C 17/002; B05C 17/00; B05C 17/003; B05C 17/005; B05C 17/00503; B05C 17/00569; B05C 17/00573; B05C 17/00576; B05C 17/01; B05C 17/0103

See application file for complete search history.

(56) References Cited

U.S. PATENT DOCUMENTS

| | | | | |
|---|---|---|---|---|
| 4,986,475 | A * | 1/1991 | Spadafora | B05B 3/02 118/24 |
| 5,882,691 | A | 3/1999 | Conboy | |
| 5,902,451 | A | 5/1999 | O'Mara et al. | |
| 5,953,799 | A | 9/1999 | Panaccione et al. | |

(Continued)

*Primary Examiner* — David J Walczak

(74) *Attorney, Agent, or Firm* — Law Office of Mark Brown, LLC; Mark E. Brown; Ryan S. Hinderliter

(57) ABSTRACT

A system for finishing surfaces with a finishing material includes a handle assembly with proximal and distal ends. A material reservoir is mounted on the handle distal and includes an inlet and an outlet. A material applicator tool is mounted on the reservoir and receives material from the reservoir outlet. A discharge mechanism includes an extendable-retractable component connected to the reservoir for discharging or reloading material. An alternative embodiment includes a lockable, compressible gas spring. Another alternative embodiment includes a rotating element driven by a reversible motor mounted on the handle assembly. The rotating element drives a discharge mechanism in a discharge direction of rotation, and reloads the reservoir in a reload direction of rotation.

7 Claims, 28 Drawing Sheets

(56) References Cited

U.S. PATENT DOCUMENTS

| | | | |
|---|---|---|---|
| 6,260,238 | B1 | 7/2001 | MacMillan |
| 6,473,939 | B1 | 11/2002 | Stegmaier |
| 6,581,805 | B2 | 6/2003 | Conboy et al. |
| 6,726,868 | B1 | 4/2004 | Panfili et al. |
| 6,742,215 | B2 | 6/2004 | Panfili et al. |
| 6,793,428 | B2 | 9/2004 | Lithgow |
| D508,638 | S | 8/2005 | Meyer et al. |
| 7,114,869 | B2 | 10/2006 | MacMillan |
| D541,616 | S | 5/2007 | Bruno et al. |
| D545,168 | S | 6/2007 | Rudder |
| D549,070 | S | 8/2007 | Bruno et al. |
| D551,053 | S | 9/2007 | Bruno et al. |
| D553,939 | S | 10/2007 | Bruno et al. |
| D553,941 | S | 10/2007 | Bruno et al. |
| D564,383 | S | 4/2008 | Bruno et al. |
| D565,921 | S | 4/2008 | Bruno et al. |
| 7,434,318 | B2 | 10/2008 | Perez et al. |
| 7,458,127 | B2 | 12/2008 | Bruno et al. |
| D584,126 | S | 1/2009 | Meyer |
| 7,556,447 | B2 * | 7/2009 | Bruggeman ..... A46B 11/0062 401/173 |
| D614,471 | S | 4/2010 | Meyer et al. |
| 8,381,789 | B2 | 2/2013 | Payne |
| 8,517,077 | B2 | 8/2013 | Payne |
| 8,747,006 | B2 | 6/2014 | Payne |
| 9,051,744 | B1 | 6/2015 | Murray et al. |
| 9,283,586 | B2 | 3/2016 | MacMillan |
| D838,159 | S | 1/2019 | Jimenez et al. |
| 2001/0003563 | A1 | 6/2001 | Schauer et al. |
| 2010/0260530 | A1 | 10/2010 | Schlecht et al. |
| 2011/0020050 | A1 * | 1/2011 | Sandahl ..... B05C 17/0325 401/176 |
| 2015/0328607 | A1 | 11/2015 | Wittbold et al. |
| 2016/0121287 | A1 | 5/2016 | Brown et al. |
| 2017/0065950 | A1 | 3/2017 | Schenck et al. |
| 2018/0087281 | A1 | 3/2018 | Murray |

* cited by examiner

1. CLOSES THROTTLE VALVE

2a. SQUEEZES (AND LATCHES TRIGGER TO INNER POSITION

2b. DEPRESSES (AND HOLDS) ACTUATOR BUTTON (aka RELEASE PIN)

3. ACTUATES PRESSURIZED CYLINDER FOR RETRACTION

4a. CHARGES RESERVOIR WITH MUD

4b. FORCES CYLINDER TO RETRACT

SYSTEM FOR APPLYING FINISHING COMPOUND

CROSS-REFERENCE TO RELATED APPLICATION

This application claims priority in U.S. Provisional Patent Application No. 62/401,579, filed Sep. 29, 2016, which is incorporated herein by reference.

BACKGROUND OF THE INVENTION

1. Field of the Invention

The present invention relates generally to: tools, equipment, and related devices that dispense semi-fluid compounds; procedures for using same; and in particular to an applicator system for finishing drywall and other surfaces.

2. Description of the Related Art

Drywall installation typically involves joining two or more panels or sheets of gypsum board together to create a larger surface, such as a wall or ceiling. This is accomplished by taping the joints and covering the tape with joint compound (or "mud"). Additional applications of mud can be used depending on the specified level of surface finish. Some drywall finishers prefer to apply the mud by hand using putty knives, but this can be a time-consuming process. To semi-automate the process, tool manufacturers have created "flat boxes" comprising reservoirs attached to handles for guiding along gypsum board or drywall joints. The flat boxes apply joint compound, normally over a strip of joint tape, along joints. The joint compound can be sanded and re-coated as necessary to achieve the specified finish level. There are also corner tools and associated reservoirs that apply mud to corner joints. The user applies pressure via a handle assembly to dispense the mud while pushing or pulling such applicators along the drywall joints.

Previous drywall finishing tools include the Continuous Flow Paste Applicator for Dry Wall shown in U.S. Patent Publication No. 2001/0003563, but the connected hoses required by this applicator can be unwieldy. Other prior art finishing systems include components that must be carried around with handle systems, e.g., as shown in U.S. Pat. No. 6,793,428 for Drywall Joint Compound Applicator Appliance, or continuously dispense compound until a brake is applied, which can lead to the tool dispensing excess compound.

There is needed in the art a handle system that will automatically dispense drywall joint compound, with a flow-driving mechanism that can be engaged without changing the position of the finishing tool relative to the work surface, and that does not tether the user due to the lengths of attached hoses and/or power cords.

Heretofore, there has not been available a surface finishing system with the features and advantages of the present invention.

SUMMARY OF THE INVENTION

In practicing an aspect of the present invention, a system is provided for automatically applying a finishing compound to a surface, e.g., joint compound ("mud"), which can be applied over joint tape to form a flush or level drywall joint. Modified or alternative aspects of the invention include lockable gas springs, piston-and-cylinder units and drive augers for dispensing the compound from a handle assembly, which can be held by an operator. Power can be applied via compressed springs extending a plunger or electric motors rotating an auger. Various application-specific finishing tools, such as mud knives for flat surfaces and corner tools (e.g., for wall-ceiling and wall-wall intersections), can be mounted on the handle assembly.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. First Modified Embodiment or Alternative Aspect of the Invention (FIGS. 1-5)

Figure 5:
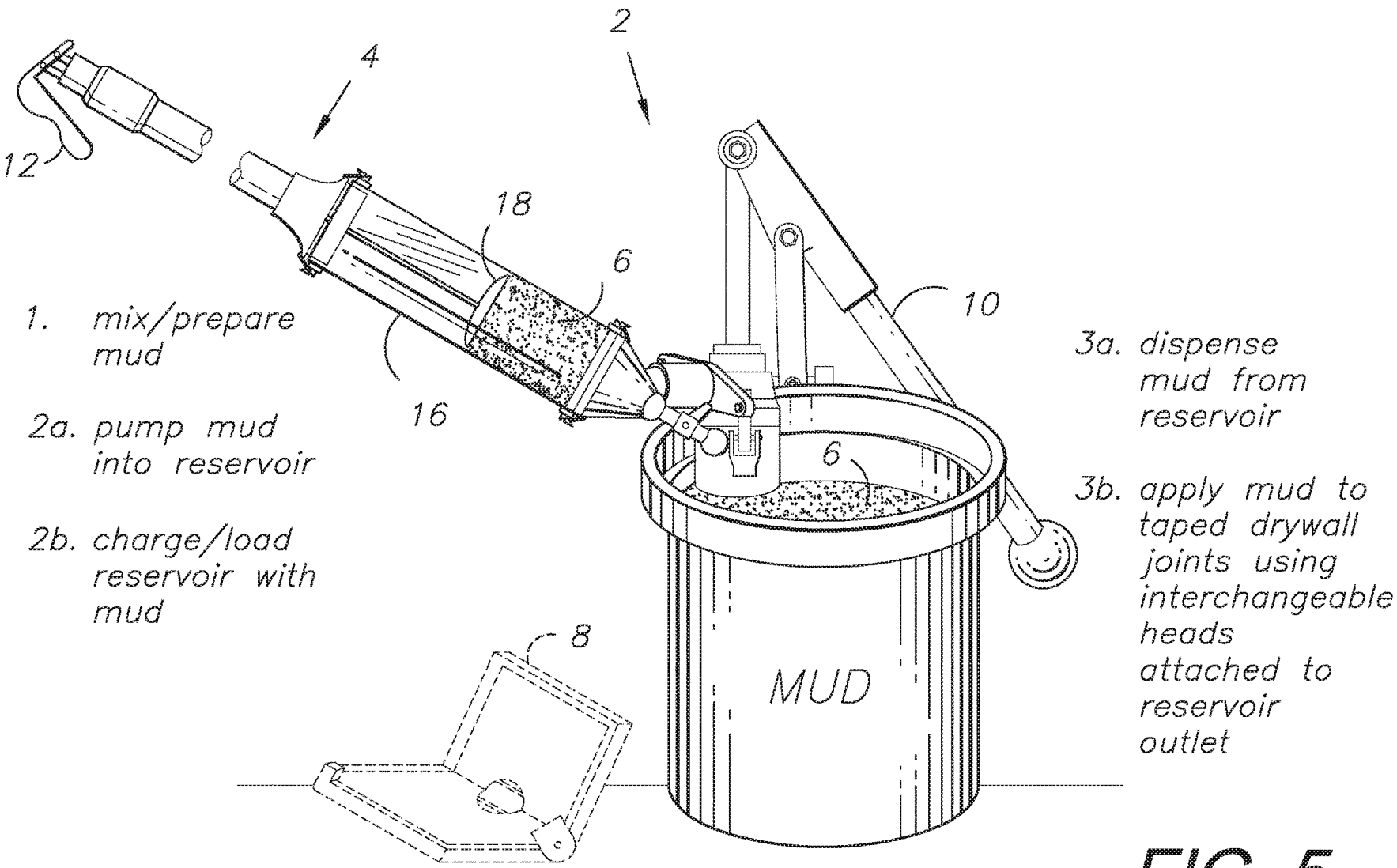
FIG. 5 shows the finishing system, including a dispensing tool thereof, a container of compound, a compound pump and a corner application attachment.
Figure 6:
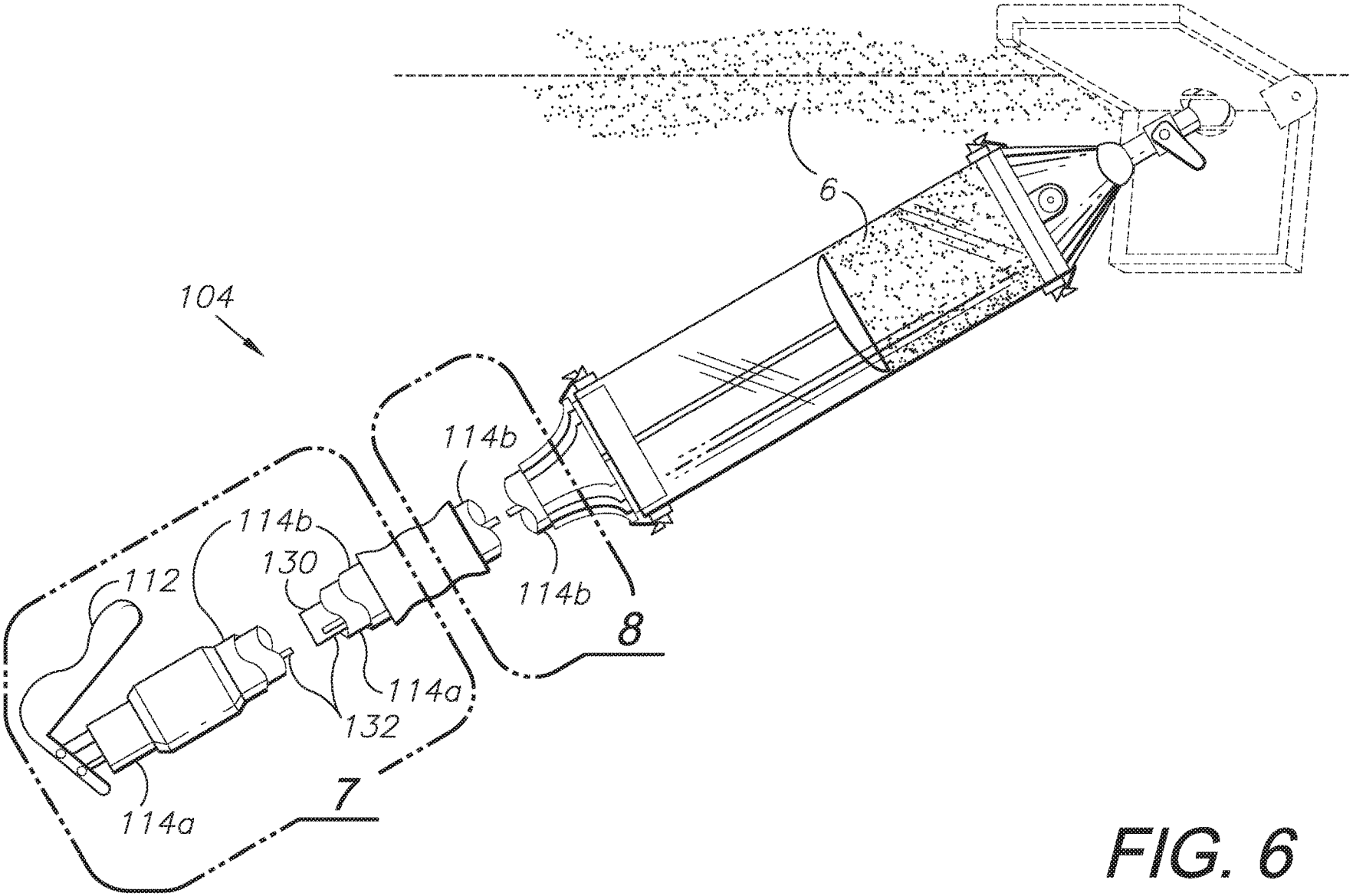
FIG. 6 shows a surface finishing system comprising an alternative or modified aspect of the present invention, shown in use finishing a ceiling-wall joint.
Figure 7:
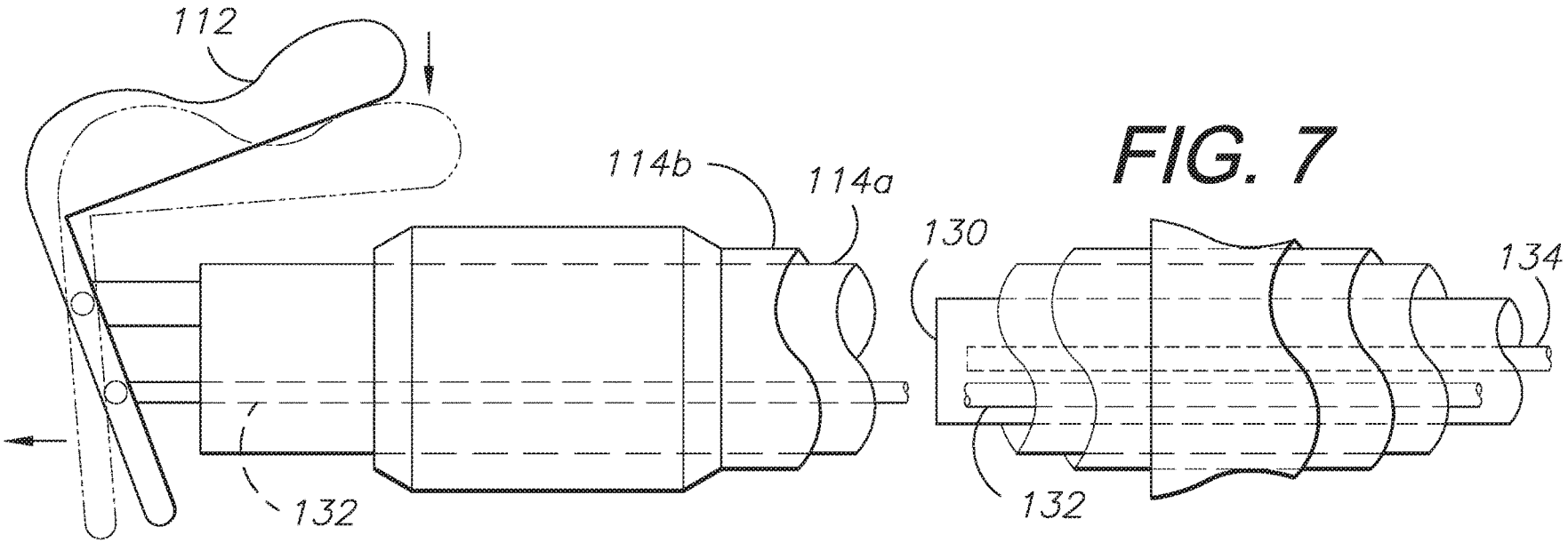
FIG. 7 is an enlarged, fragmentary view thereof, taken generally within area 7 in FIG. 6.
Figure 9:
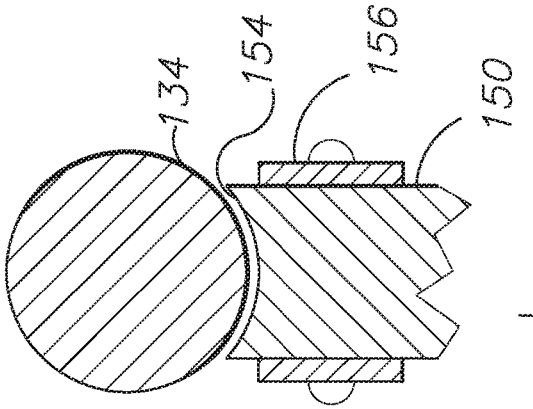
FIG. 9 is a cross-sectional view thereof taken generally along line 9-9 in FIG. 8A and particularly showing a cam surface engagement with a slave rod.

Referring to FIGS. 1-5, a compound application or surface finishing system 2 employs a compound-dispensing tool 4 to apply a quantity of material 6, such as drywall finishing compound or "mud", to some other material or surface 7, such as taped drywall joints. The compound 6 can be applied using a removable, interchangeable application tool 8 (e.g., a drywall compound distribution box) attached to a reservoir 16 outlet, said reservoir 16 capable of containing an amount of compound 6. In an embodiment of the application system 2 a pump 10 is used to move compound 6 from a source (e.g., a finishing compound bucket as shown in FIG. 5) and into the reservoir 16 via a fill access port 22 for reloading or recharging the reservoir 16 as the material 6 is applied and used. A plunger 18 can be employed to push and dispense the material 6 out of the reservoir 16. An embodiment of the invention can also include a ball throttle valve 24 to control dispensing the compound 6 from the reservoir 16. Part of the compound-dispensing assembly 4 of the invention can also include one or more openable clamp assemblies 20 for ease of removing the reservoir from a handle 14 in order to access, open, or dismantle the assembled tool for cleaning, storage, or for any other reason.

A handle 14 can extend the distance between a user and the intended application surface 7. Various embodiments of certain features of the invention can also be mounted onto or in the handle 14.

The extendable-retractable handle 14 can include one or more sections 14*a*, 14*b*, etc., which can telescope with respect to each other. A pressurized cylinder 30 can be mounted in the handle 14 for dispensing a quantity of material 6, such as drywall finishing compound or "mud."

A tool assembly 4 includes a release lever 12, which is actuated by squeezing the lever 12 towards the body of the handle 14, thereby retracting a master rod 32 which rotates a first embodiment braking mechanism 38 (in this case, a pinch brake 40) thereby releasing a slave rod 34 which is a piston of the pressurized cylinder 30. The piston 34 is connected to the reservoir plunger 18. With the release lever 12 depressed, gas and/or spring pressure within the cylinder 30 pushes the slave rod 34 outwardly for continuous compound 6 dispensing until the release lever 12 is released or the handle reservoir 16 requires recharging with compound material 6.

Figure 1:
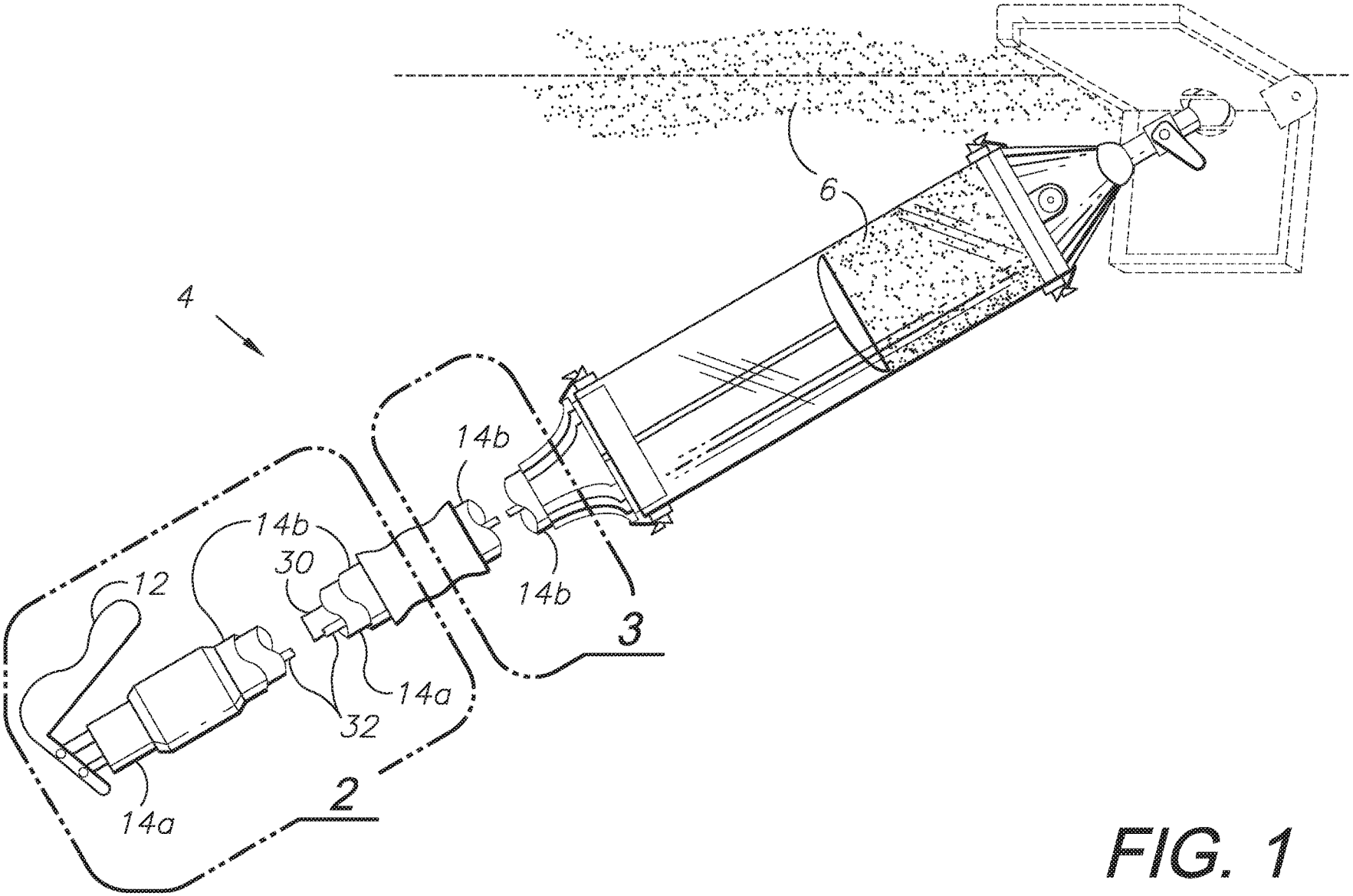
FIG. 1 shows a finishing compound dispensing system comprising an aspect of the present invention, shown in use applying finishing compound to a wall-ceiling joint.
Figure 2:
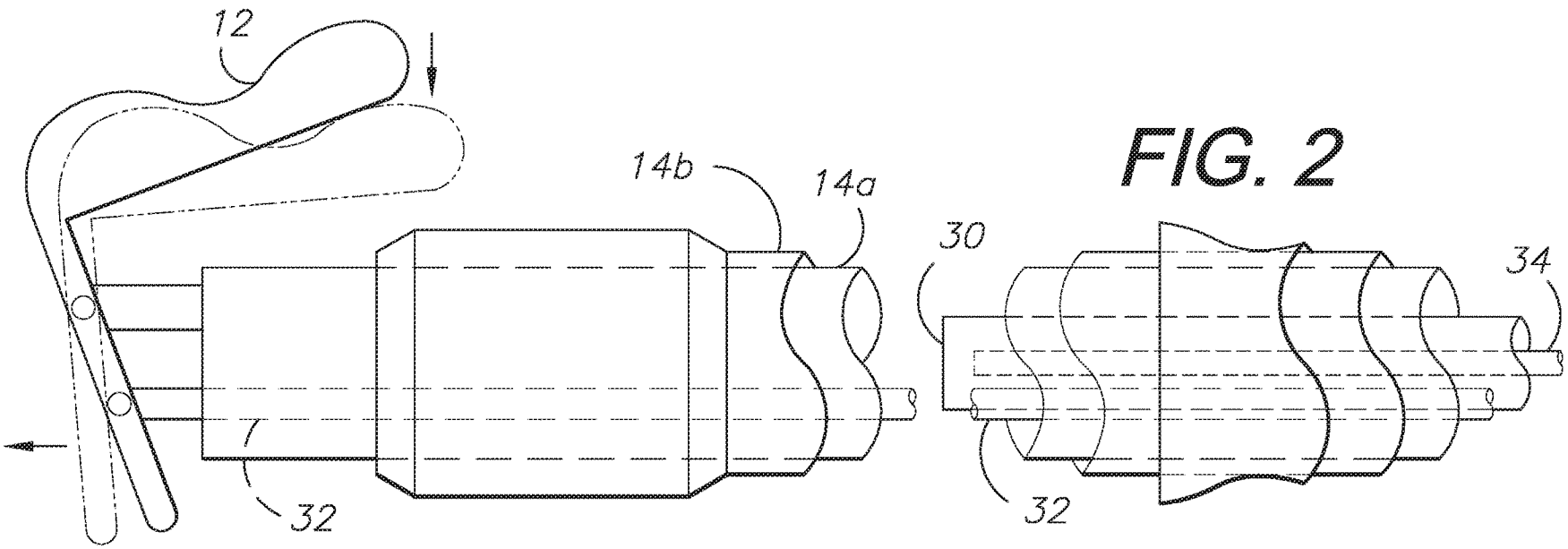
FIG. 2 is an enlarged, fragmentary view thereof, taken generally within area 2 in FIG. 1.
Figure 3:
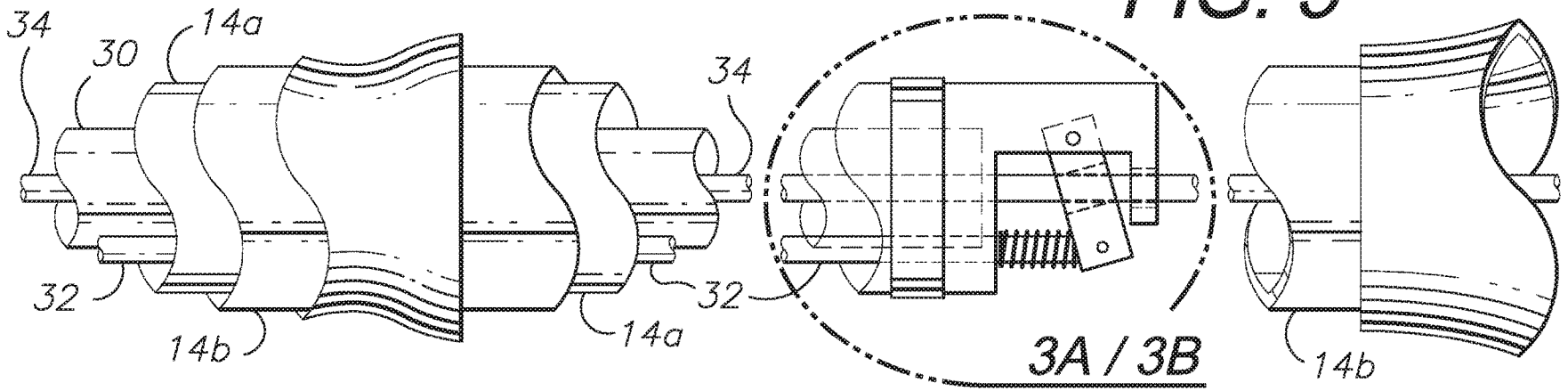
FIG. 3 is an enlarged, fragmentary view of a locking mechanism thereof, taken generally within area 3 in FIG. 1.
Figure 3A:
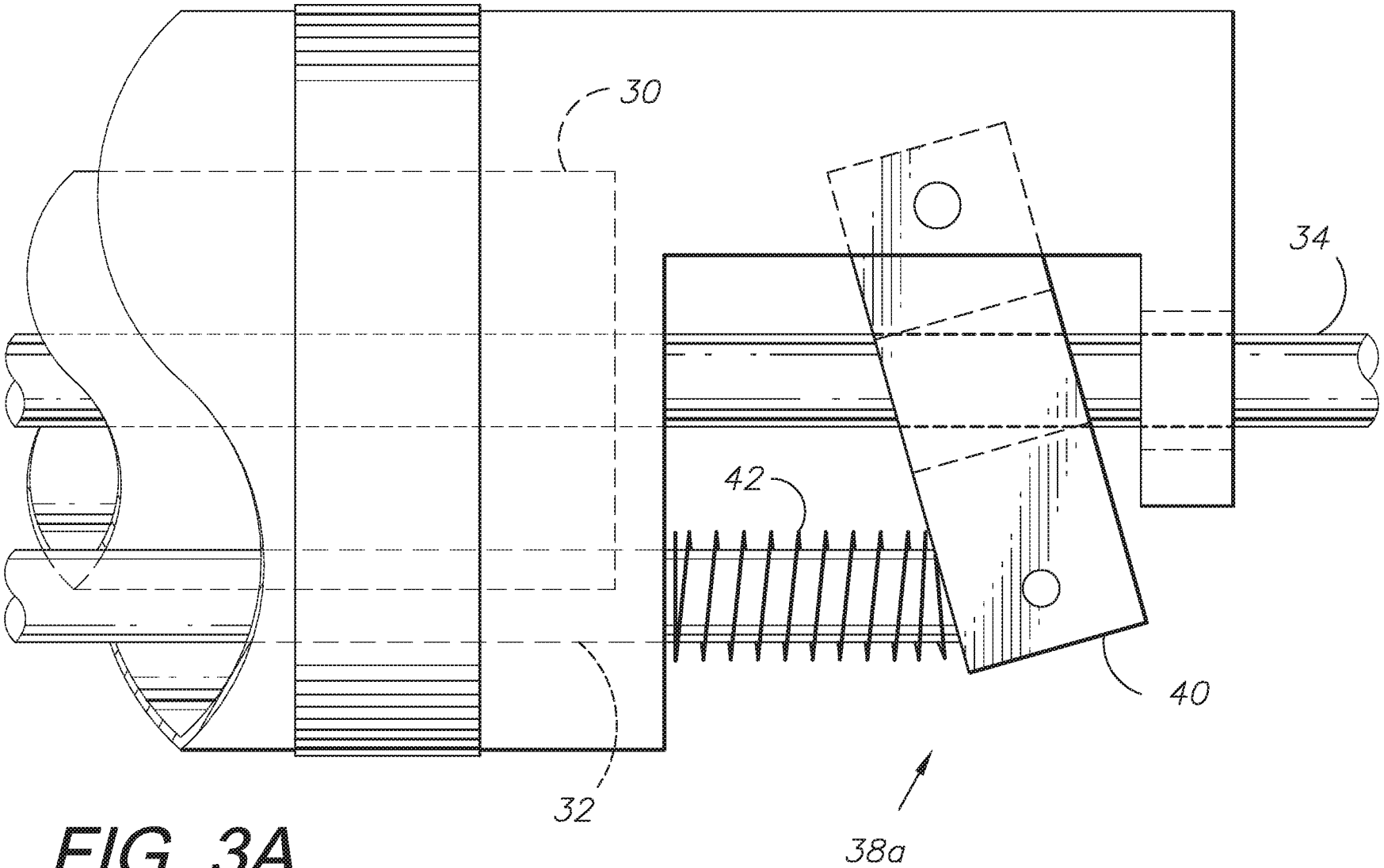
FIGS. 3A and 3B show the locking mechanism in locked and unlocked positions, respectively.
Figure 3B:
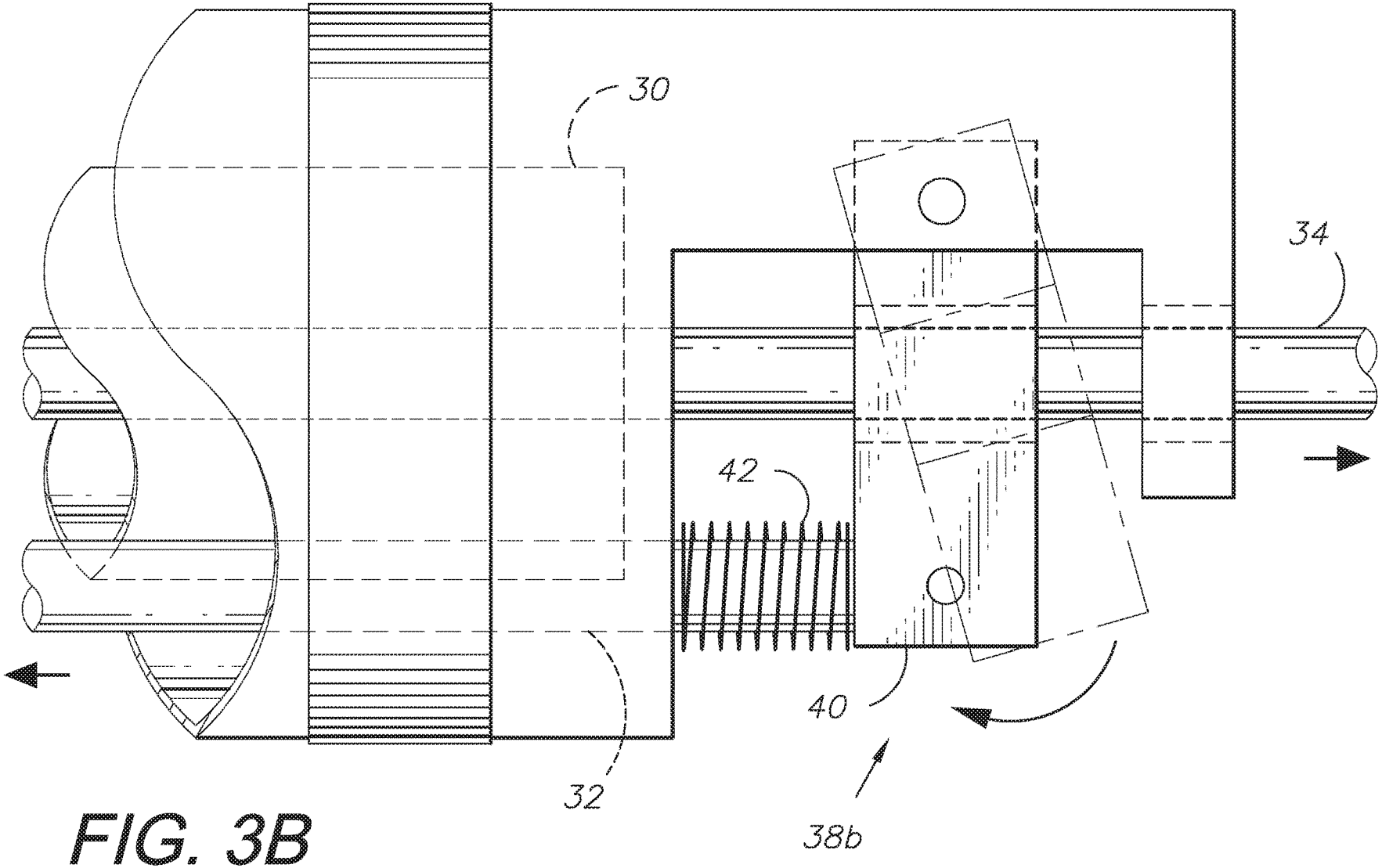
Figure 4:
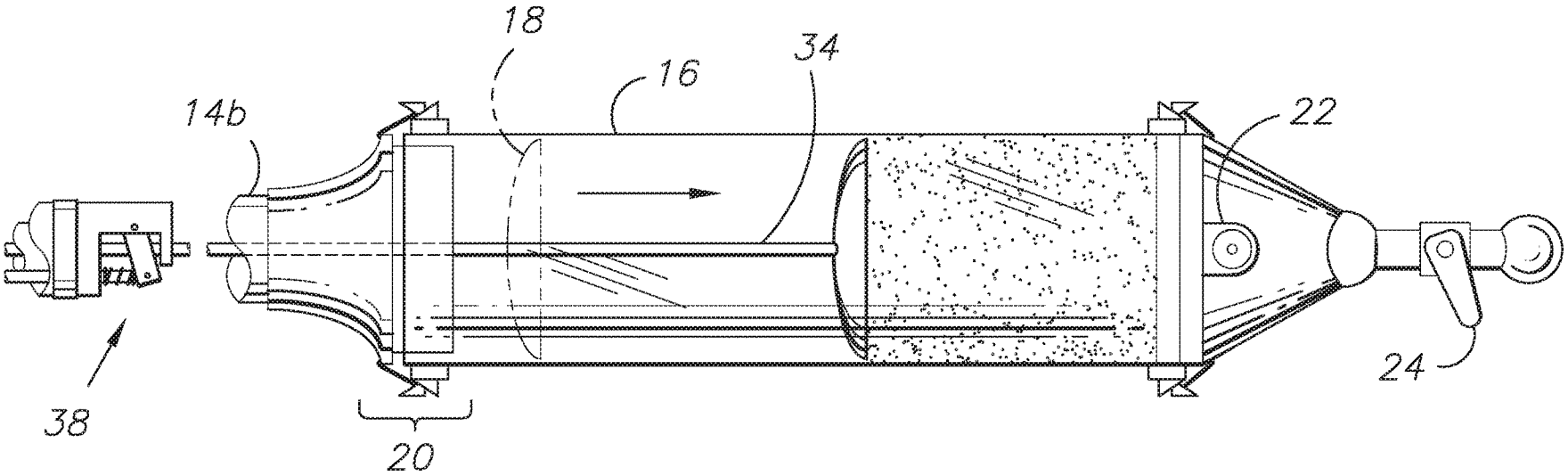
FIG. 4 is a side elevational view thereof, with portions broken away to reveal internal construction.

Upon releasing the lever 12, a first embodiment brake compression spring 42 (compressed with the retracted master rod 32) expands and extends the master rod 32, rotating the pinch brake 40 of the braking mechanism 38 in the opposite direction, thereby braking the outward motion of the slave rod 34. FIGS. 3, 3A, and 3B respectively show locked and unlocked positions 38*a*, 38*b* of the braking mechanism 38.

Reversing the direction of the slave rod 34 follows a sequence similar to that of the standard use sequence: squeezing the lever 12 retracts the master rod 32, which rotates the braking mechanism 38, thereby releasing the slave rod 34, at which point inward pressure on the opposite end of the piston 34 would re-pressurize the gas and/or spring pressure within the cylinder 30 with the slave rod 34 returned to its initial position, ready for the process to be repeated, and for recharging or reloading the reservoir 16 with drywall compound 6.

FIG. 5 shows the system 2 in a charging or loading procedure with joint compound 6 being loaded into the reservoir 16 using the pump 10, which can be placed in a bucket or other container of joint (drywall) compound. The compound 6 is pumped into the reservoir 16 through the inlet access port 22.

III. Second Modified Embodiment or Alternative Aspect of the Invention (FIGS. 6-11)

A second embodiment or aspect of the invention comprising a system designated 102 with a compound-dispensing tool 104 incorporates the use of a cam 150 in place of a pinch brake 40 and is shown in FIGS. 6-11. The cam 150 can include a groove 154 to increase surface contact between the cam 150 and a slave rod 134, thereby increasing friction and reducing the force necessary to brake the motion of the slave rod 134. A master rod 132 can attach to the cam 150 by means of a clevis assembly 156 that accommodates rotation of the cam 150.

Figure 8:
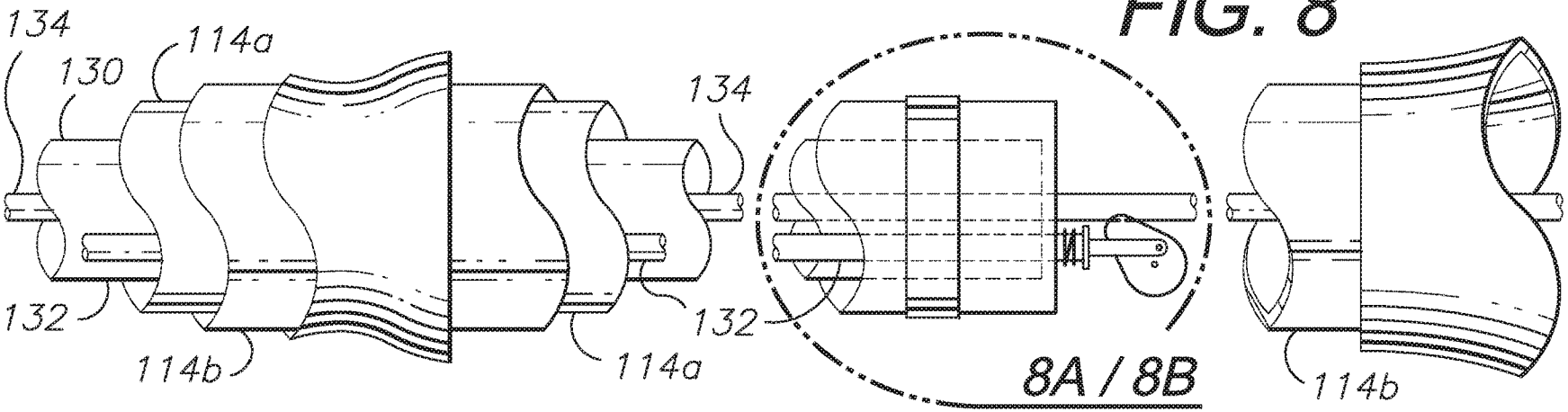
FIG. 8 is an enlarged, fragmentary view thereof, taking generally within area 8 in FIG. 6 and showing a cam-actuated locking mechanism for a pushrod thereof.
Figure 8A:
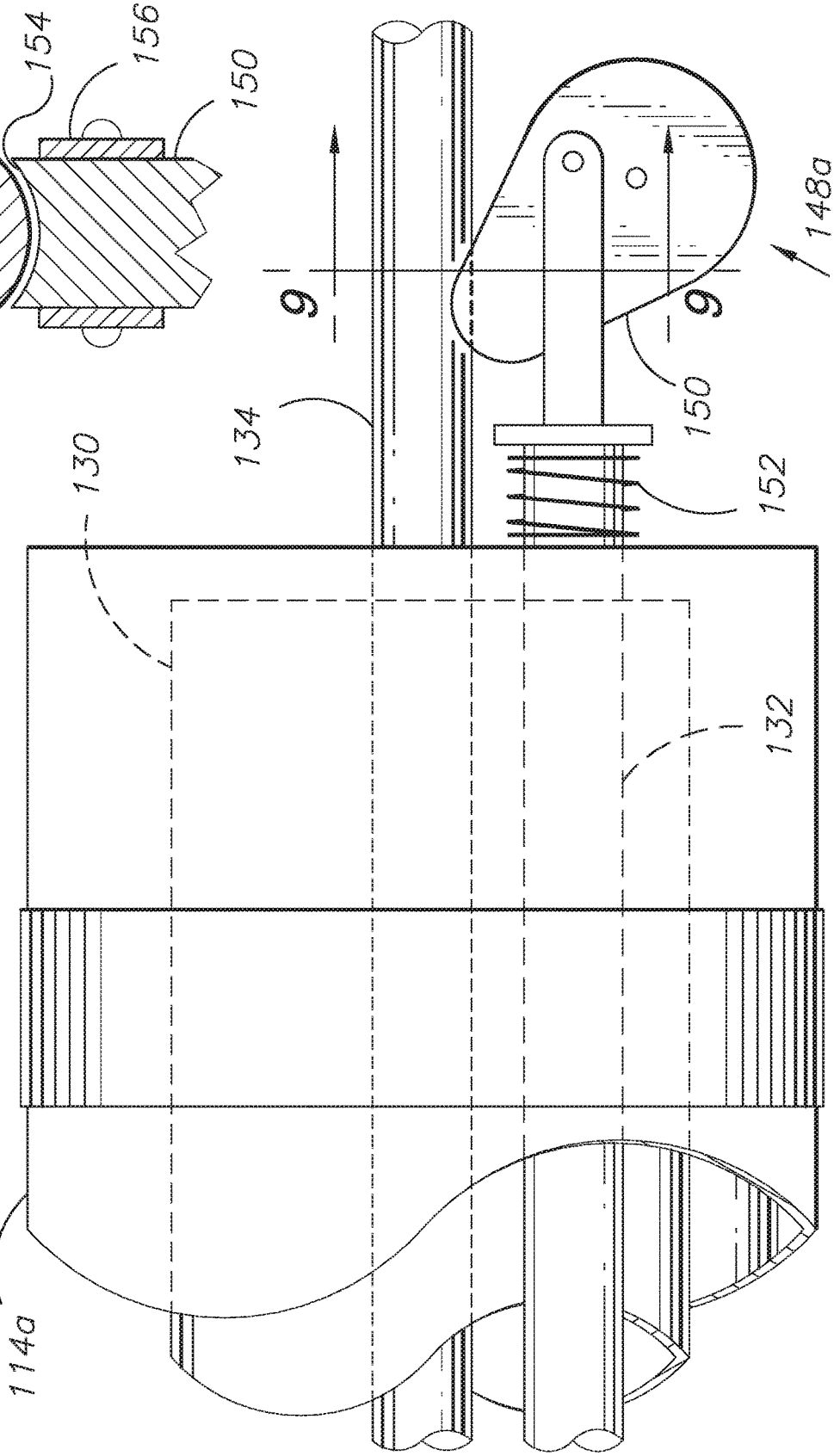
FIGS. 8A and 8B show the locking mechanism in locked and unlocked positions, respectively.
Figure 8B:
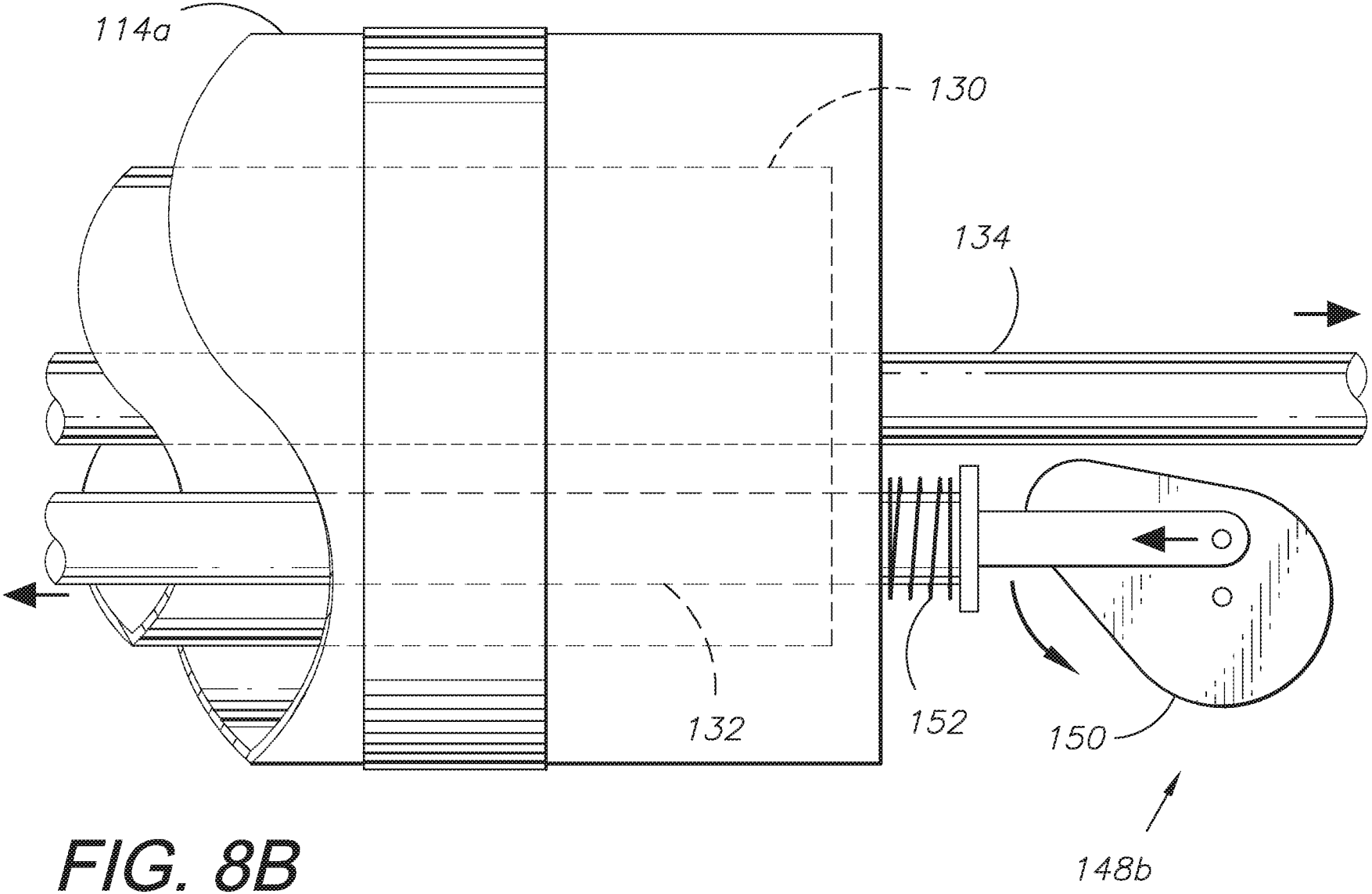
Figure 10:
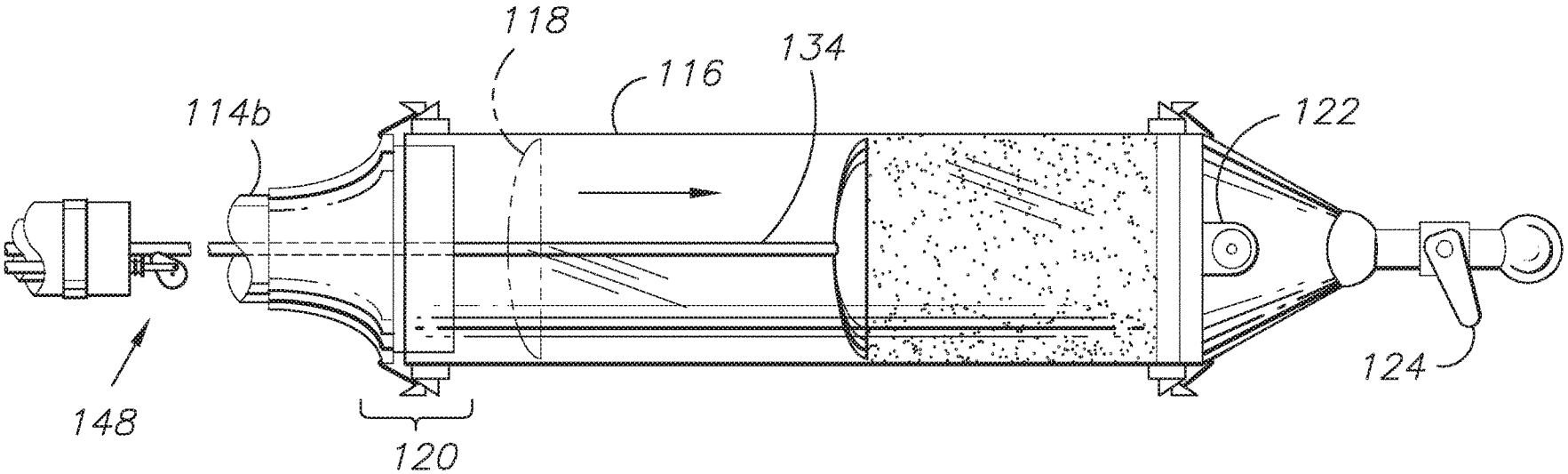
FIG. 10 is an enlarged, fragmentary, elevational view thereof.
Figure 11:
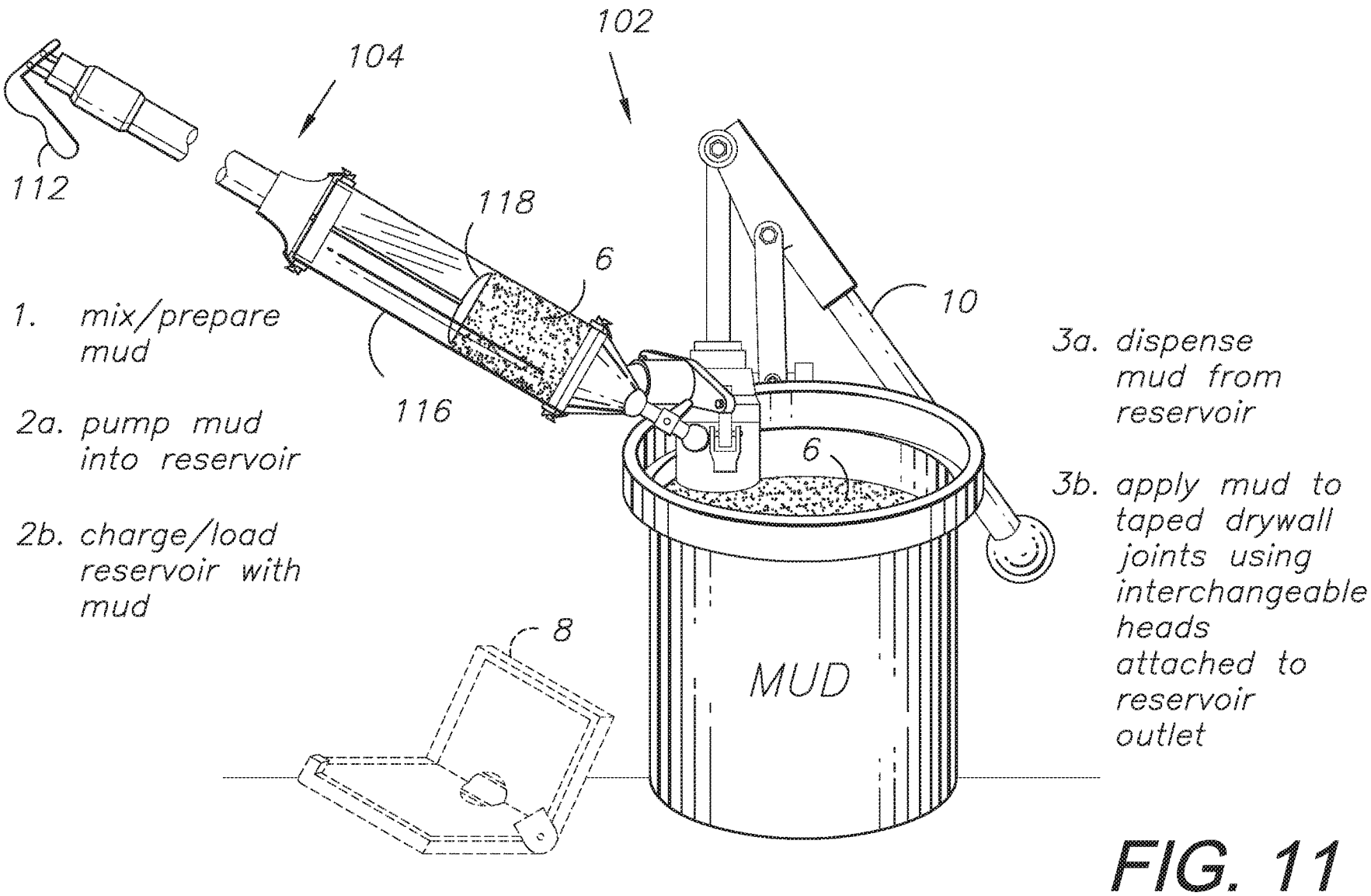
FIG. 11 shows the dispensing tool with a container of compound material, a corner-finishing attachment and a compound pump.
Figure 12:
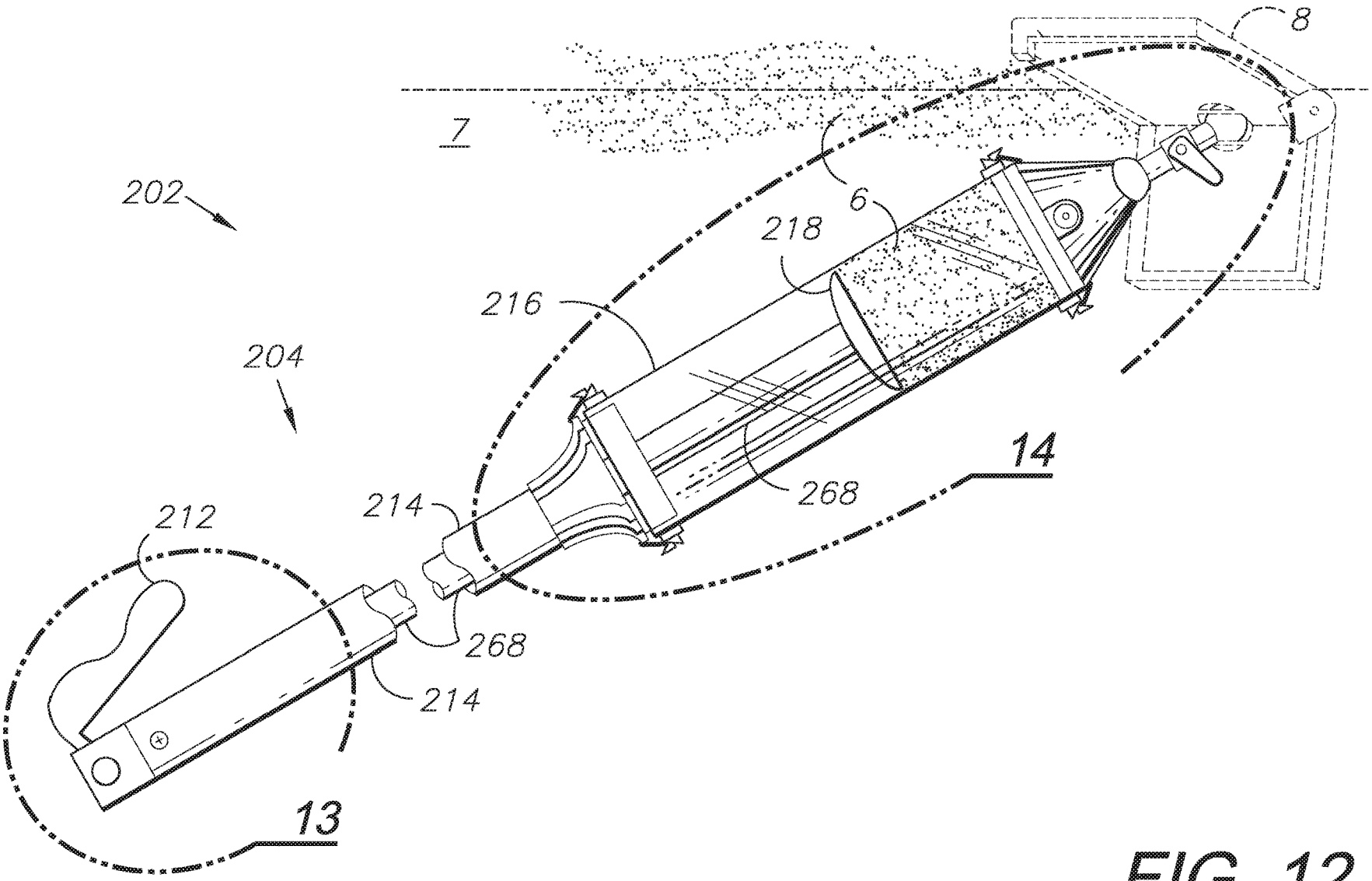
FIG. 12 shows a compound dispensing tool comprising another alternative or modified embodiment of the present invention, shown in use applying compound material to a wall-ceiling joint.

Similar to the operation of the previous embodiment, upon releasing a release lever 112, a second embodiment brake compression spring 152 squeezed by a retracted master rod 132 is allowed to expand, thereby extending the master rod 132, rotating the cam 150 of a braking mechanism 148 (in this case, a cam brake) in the opposite direction, thereby braking the outward motion of the slave rod 134. FIGS. 8A and 8B respectively show a locked position 148*a* and an unlocked position 148*b* of the braking mechanism 148.

The handle 114 can include one or more sections 114*a*, 114*b*, etc. and can be connected to a source of the compound 6 for reloading or recharging a reservoir 116 as the material 6 is applied and used. A reservoir plunger 118 can be mounted to the end of the slave rod 134 to ease dispensing. Alternative arrangements for locking and releasing the piston rod 134 of a piston 134 and cylinder 130 unit are provided. These can include, without limitation, rotatable plates, cams, and other braking mechanisms. A non-limiting example of an application for the extendable handle 114 is a drywall finishing tool 104 mounting a drywall compound (mud) distribution box 8, as well as various other taping, sanding, painting, and finishing tools and equipment.

The system 102 can, similarly to the previous embodiment, incorporate a fill access port 122, a ball valve throttle 124, and one or more openable clamp assemblies 120 to simplify use.

IV. Third Modified Embodiment or Alternative Aspect of the Invention (FIGS. 12-18)

A third embodiment or aspect of the invention (FIGS. 12-18) comprising a system designated 202 with a compound-dispensing assembled tool 204 incorporates the use of a locking, pressurized gas cylinder 268 unit (such as those manufactured by Bansbach Easylift of Lorch, Germany, for example) actuated by a release pin 264 pressed by a projection 262 of a release lever or trigger mechanism 212. Squeezing the release lever 212 (also referred to as a "trigger") toward the body of a handle 214 causes the projection 262 on the trigger mechanism 212 to depress the release pin 264 of a piston rod 266 of the locking, pressurized gas cylinder 268, thereby unlocking it. With the cylinder 268 unlocked the piston rod 266 extends and the tool dispenses compound 6 until the trigger 212 is released or the handle reservoir 216 requires recharging with compound material 6. A plunger 218 within the reservoir 216 is mounted on the end of the cylinder 268.

Upon release of the trigger 212, the release pin 264 is no longer depressed and the locking, pressurized gas cylinder 268 locks, thereby braking the outward motion of the plunger 218.

Reversing the direction of the cylinder 268 follows a sequence similar to that of the standard use sequence: squeezing the trigger 212 depresses the release pin 264, thereby unlocking the pressurized cylinder 268, at which point inward (retracting) pressure on the opposite end of the cylinder 268 would re-pressurize the gas pressure within the cylinder 268 and return the cylinder 268 to its initial position relative to the piston rod 266, ready for the process to be repeated.

Figure 13:
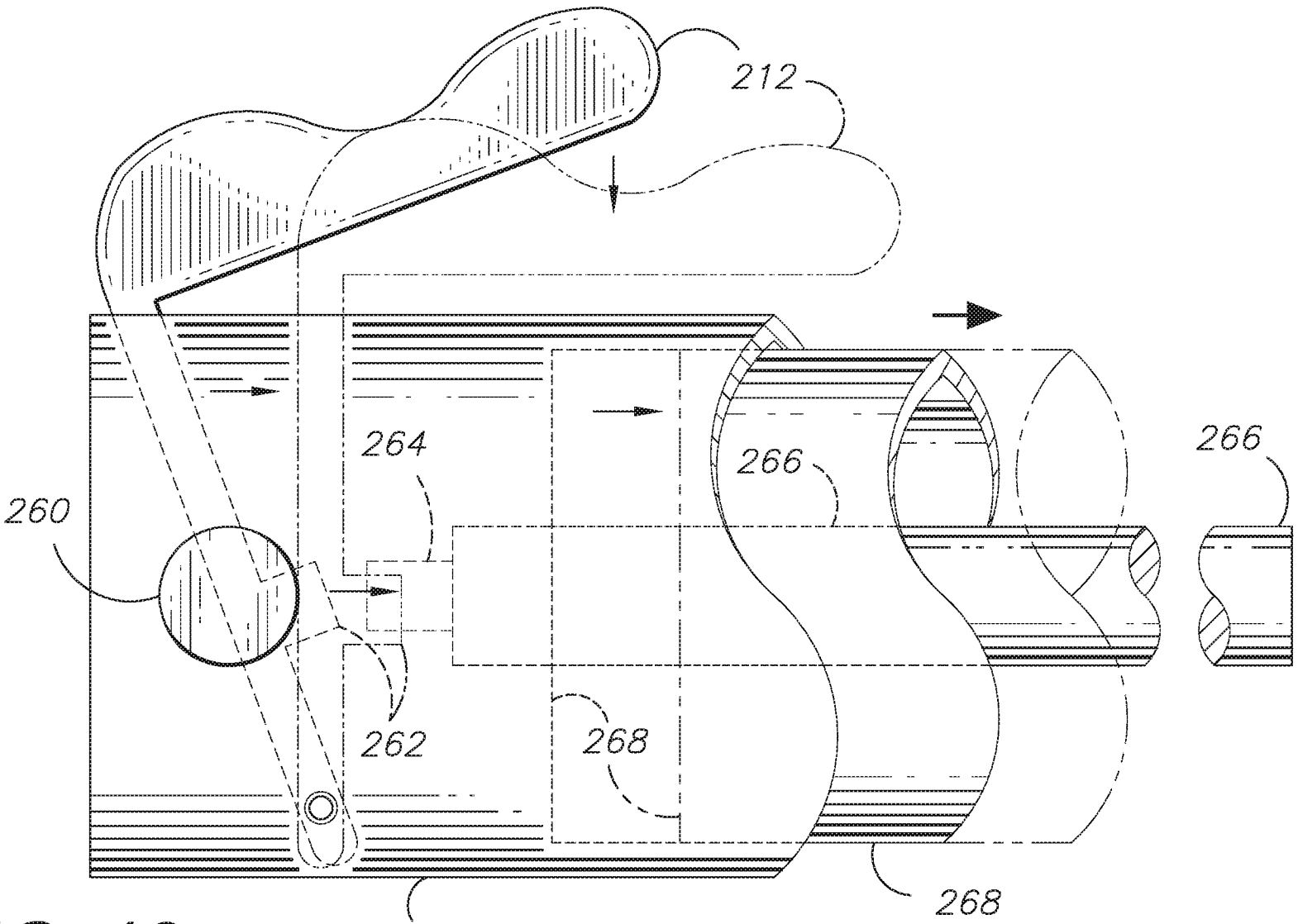
FIG. 13 is an enlarged, fragmentary view thereof, taken generally in area 13 in FIG. 12, and particularly showing an actuating handle and actuating mechanism.
Figure 13B:
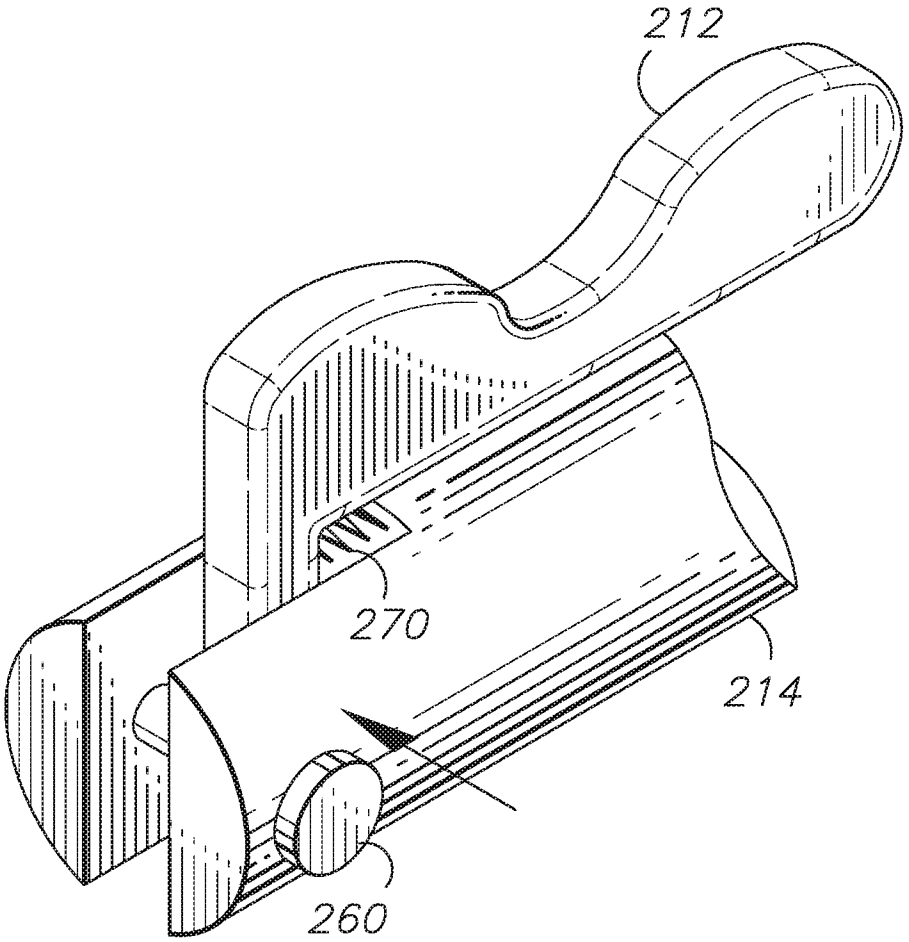
FIGS. 13A and 13B are fragmentary, perspective views of a release lever locking mechanism of the invention, shown in unlocked and locked positions, respectively.
Figure 13A:
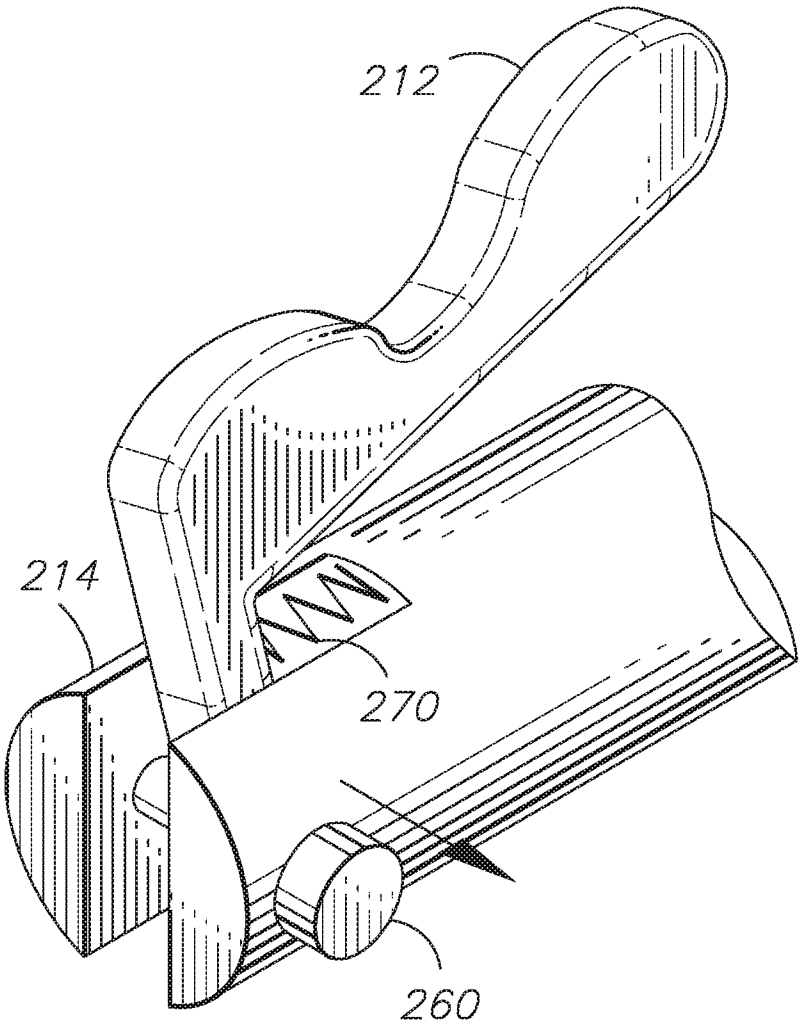
Figure 14:
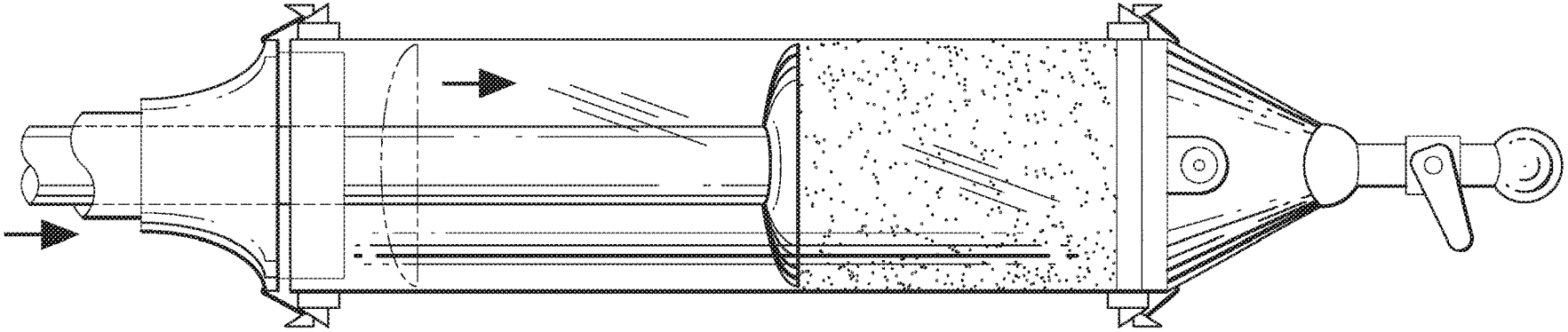
FIG. 14 is an enlarged, fragmentary view thereof, taken generally in area 14 in FIG. 12.
Figure 15:
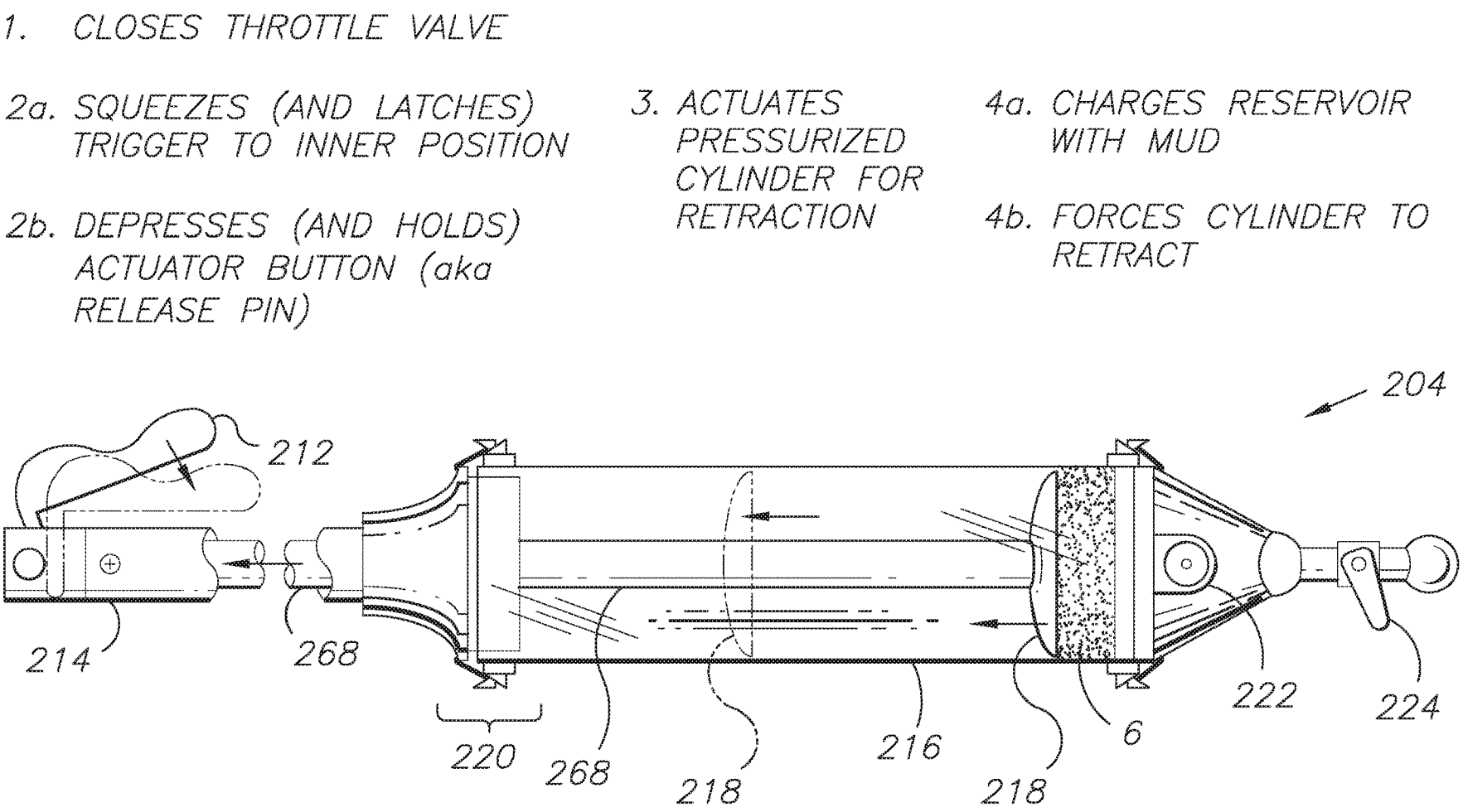
FIG. 15 is an elevational view thereof with a description of a procedure for charging the device with compound material.
Figure 16:
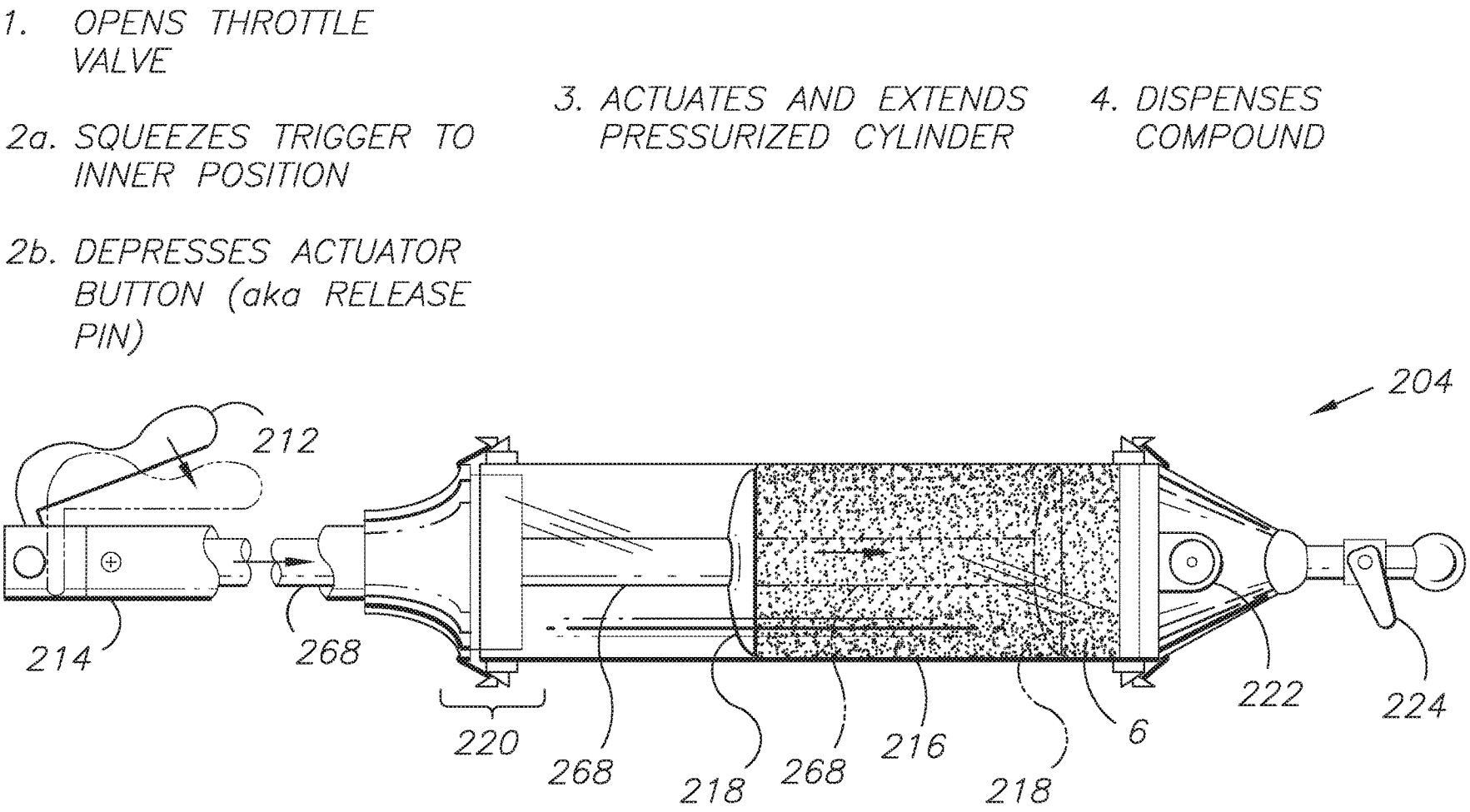
FIG. 16 is an elevational view of the invention with a description of a procedure for operating the dispenser.
Figure 17:
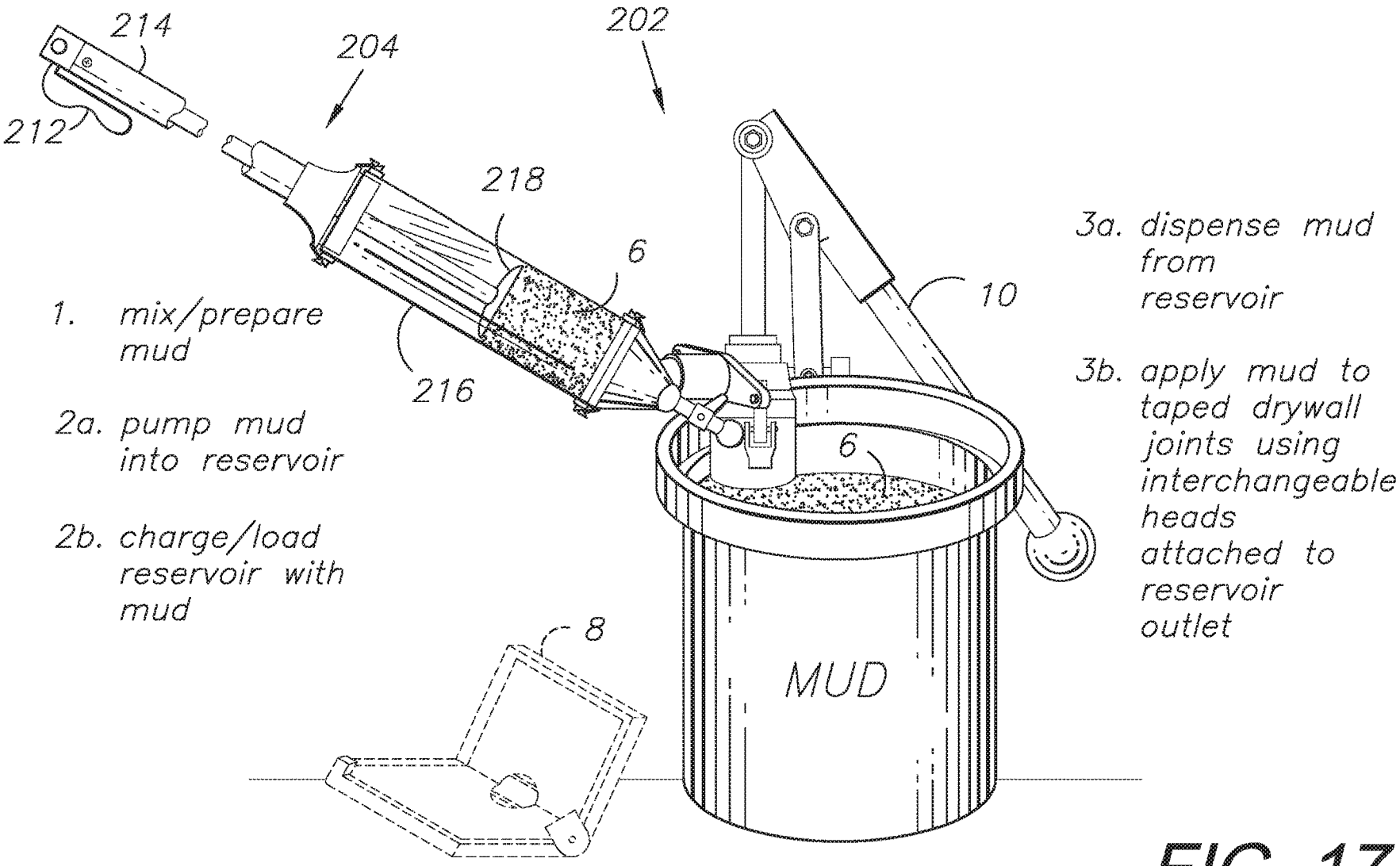
FIG. 17 is a view thereof including a compound material container, a compound pump and a corner finishing tool.
Figure 18:
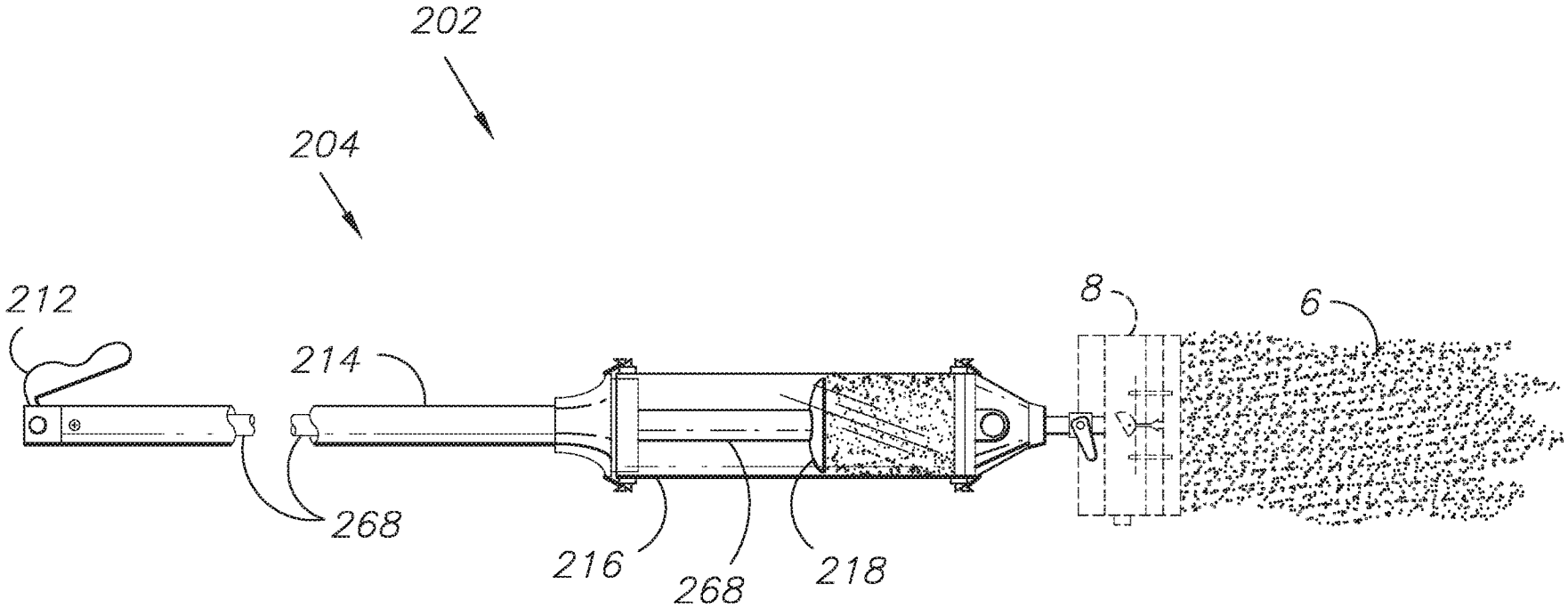
FIG. 18 is an elevational view thereof, shown in use.
Figure 19:
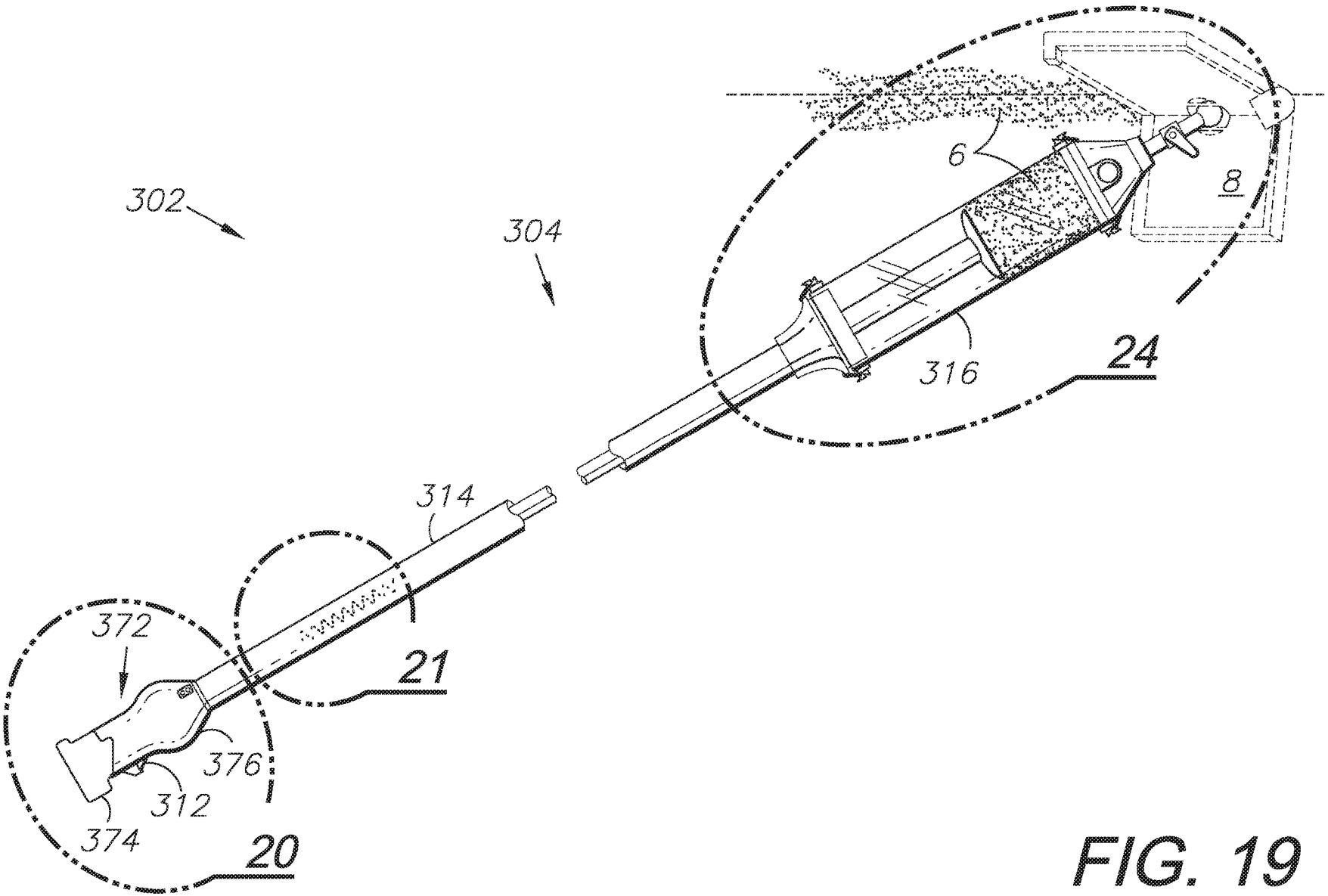
FIG. 19 shows another alternative or modified aspect of the invention, shown in use and including a rechargeable battery power source.
Figure 20:
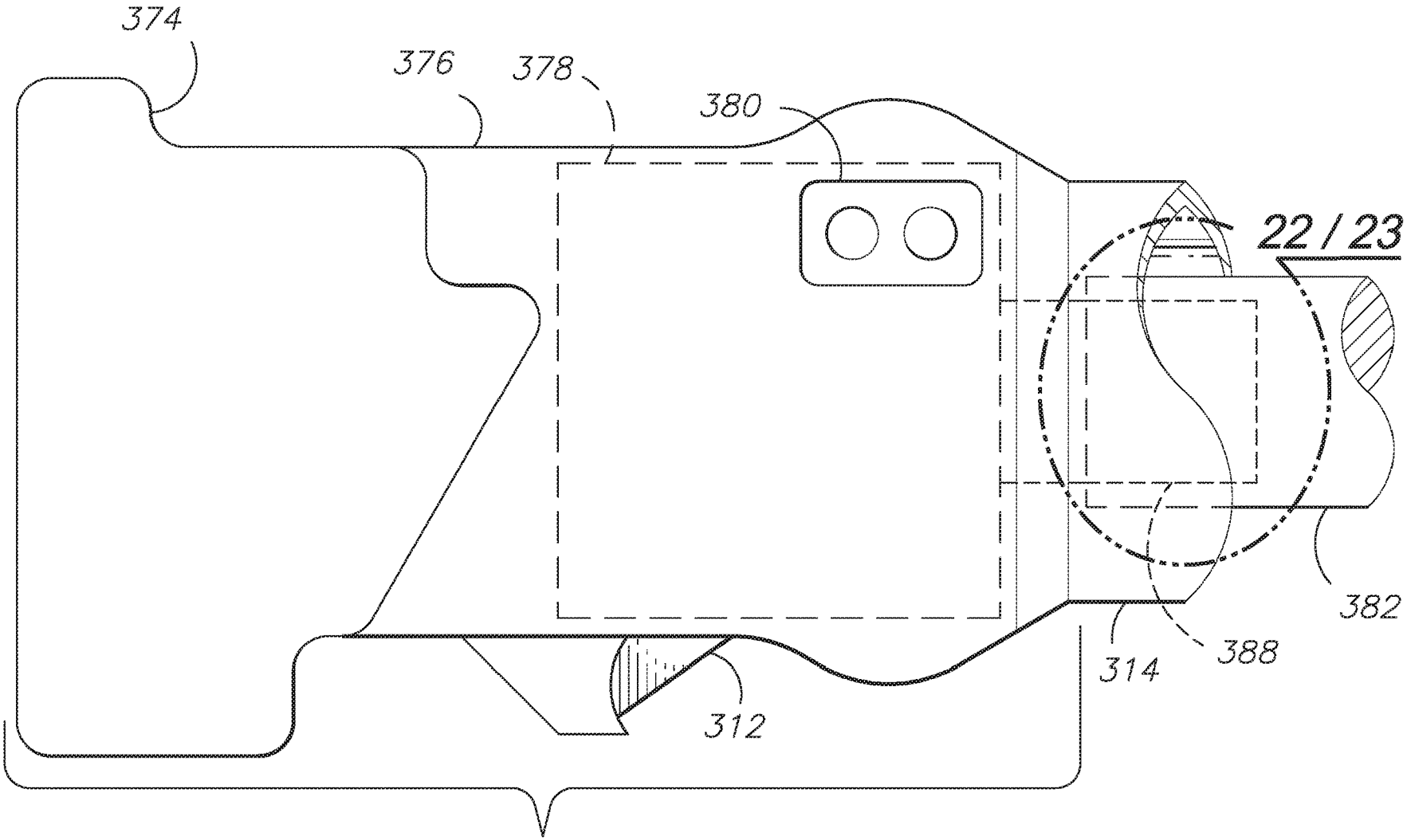
FIG. 20 is an enlarged, fragmentary view thereof, taken generally in area 20 in FIG. 19.
Figure 21:
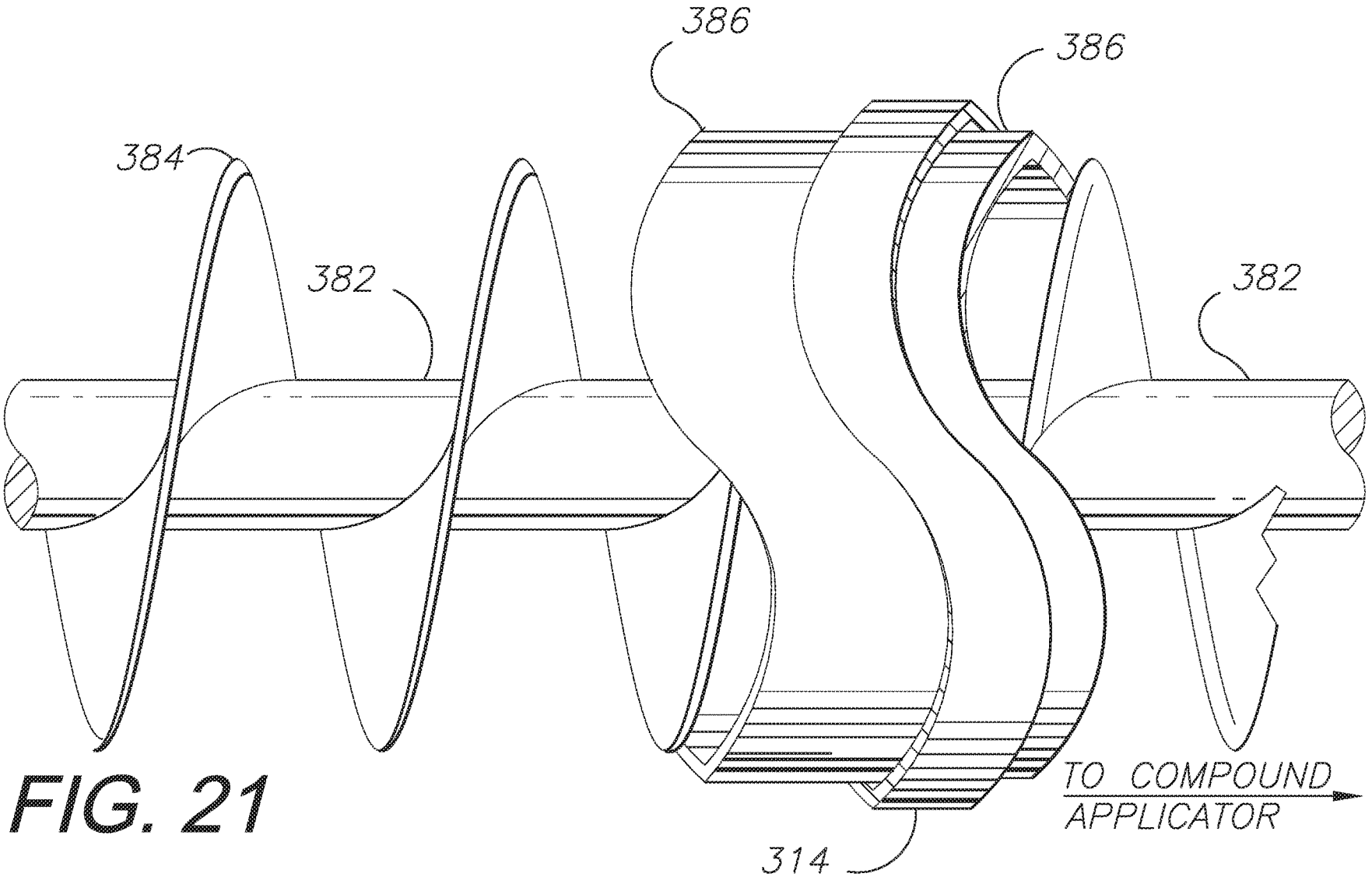
FIG. 21 is an enlarged, fragmentary view thereof, taken generally in area 21 in FIG. 19.

The system 202 can also include a trigger latch 260. FIG. 13A shows the trigger mechanism 212 in an un-engaged, extended position. The trigger latch button 260 extends from the body of the handle 214 with the trigger mechanism 212 in its extended, un-engaged position (FIG. 13A). Squeezing the trigger mechanism 212 inwardly towards the handle 214 rotates the trigger mechanism 212 out of the way of the latch 260 which can then be depressed (FIG. 13B) to retain the trigger mechanism 212 from rotating back to its un-engaged position. Upon pressing the latch button 260 again, the latch "pops out" of the way of the trigger 212. A trigger compression spring 270, compressed by the trigger, can now expand, pushing the trigger 212 back to its un-engaged position. This arrangement can aid in continuous compound 6 dispensing without requiring a user to squeeze the trigger the entire time.

Alternatively, the dispensing-locking positions of the trigger mechanism 212 can be reversed whereby squeezing the trigger mechanism 212 causes the tool assembly 204 to dispense material. The operation of the latch 260 can likewise be changed as appropriate for particular applications and to accommodate user preferences.

The system 202 can, similarly to the previously-described embodiments, incorporate a fill access port 222, a ball valve throttle 224, and/or one or more openable clamp assemblies 220 to simplify use.

V. Fourth Modified Embodiment or Alternative Aspect of the Invention (FIGS. 19-27)

Yet another alternative embodiment or aspect of the invention (FIGS. 19-27) comprises a system designated 302 and including a compound-dispensing tool 304 driven by a motor unit 372 at a proximal end of a handle 314. The motor unit 372 is powered by a rechargeable battery 374 and actuated by a trigger mechanism 312. Depressing the trigger 312, that is, squeezing it toward the body of the handle 314, activates a motor 378 which receives power from the battery 374. The motor 378 rotates a motor shaft 388 which, in turn, rotates an auger shaft 382 and auger 384, which advances the compound material 6 for discharge via an application tool 8.

Alternatively, the motor 378 can drive a threaded shaft threadably connected to a plunger 318 for expelling the material 6 contents of the reservoir 316. Upon release of the trigger 312 the motor 378 is no longer powered and ceases to rotate the shaft 382, thereby stopping the discharge flow of material 6.

A variable- or static-speed forward/reverse (reverse optional) switch 380 can be included in the assembled tool 304. The switch 380 can control the speed and rotational direction of the motor 378 and can be housed with the motor 378 within the motor housing 376. The switch 380 can include forward and reverse closed positions for dispensing compound 6 or reloading (recharging) the reservoir 316, or retracting the plunger 318.

Threaded rods, plungers and other operative components can be utilized with a reversible electric motor, such as the drive motor 378. Moreover, compound materials 6 can be loaded into and discharged from hollow portions of handles (e.g., 314) and/or reservoirs (e.g., 316) using suitable augers or shaft-plunger assemblies, which are rotated by the drive motor 378. For example, the threaded shaft 386 could extend through most of the length of the reservoir 316 and threadably mount the plunger 318 thereon for advancing and retracting through the reservoir 316 in a reciprocating range of motion.

Figure 22:
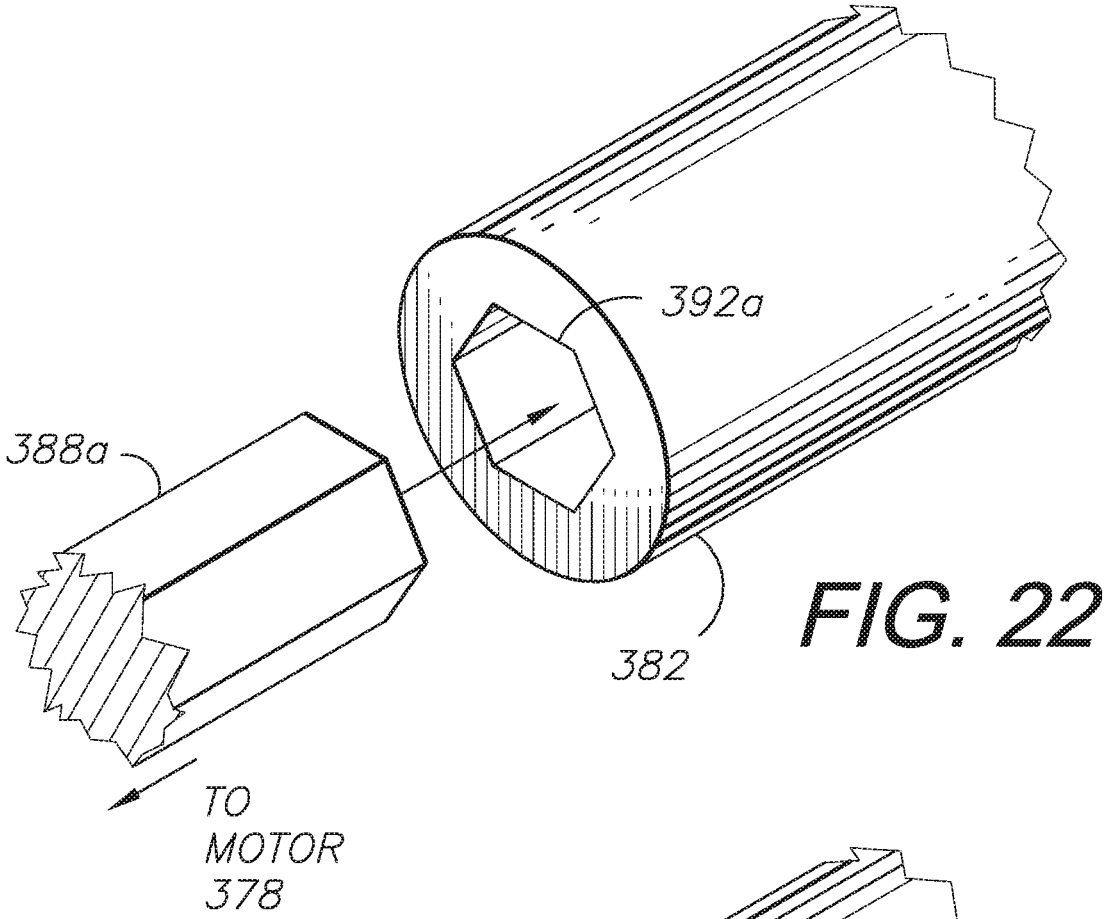
FIG. 22 is a fragmentary, perspective view thereof taken generally in area 22/23 in FIG. 20, particularly showing a connection between the motor shaft and the auger shaft.

FIG. 22 shows a mating connection between the motor 378 and the auger shaft 382. In this mating connection a hexagonal motor shaft 388*a* fits into a hexagonally-shaped hub 392*a* inside the auger shaft 382. This removable mating connection allows the motor 378 to rotate the auger shaft 382.

Figure 23:
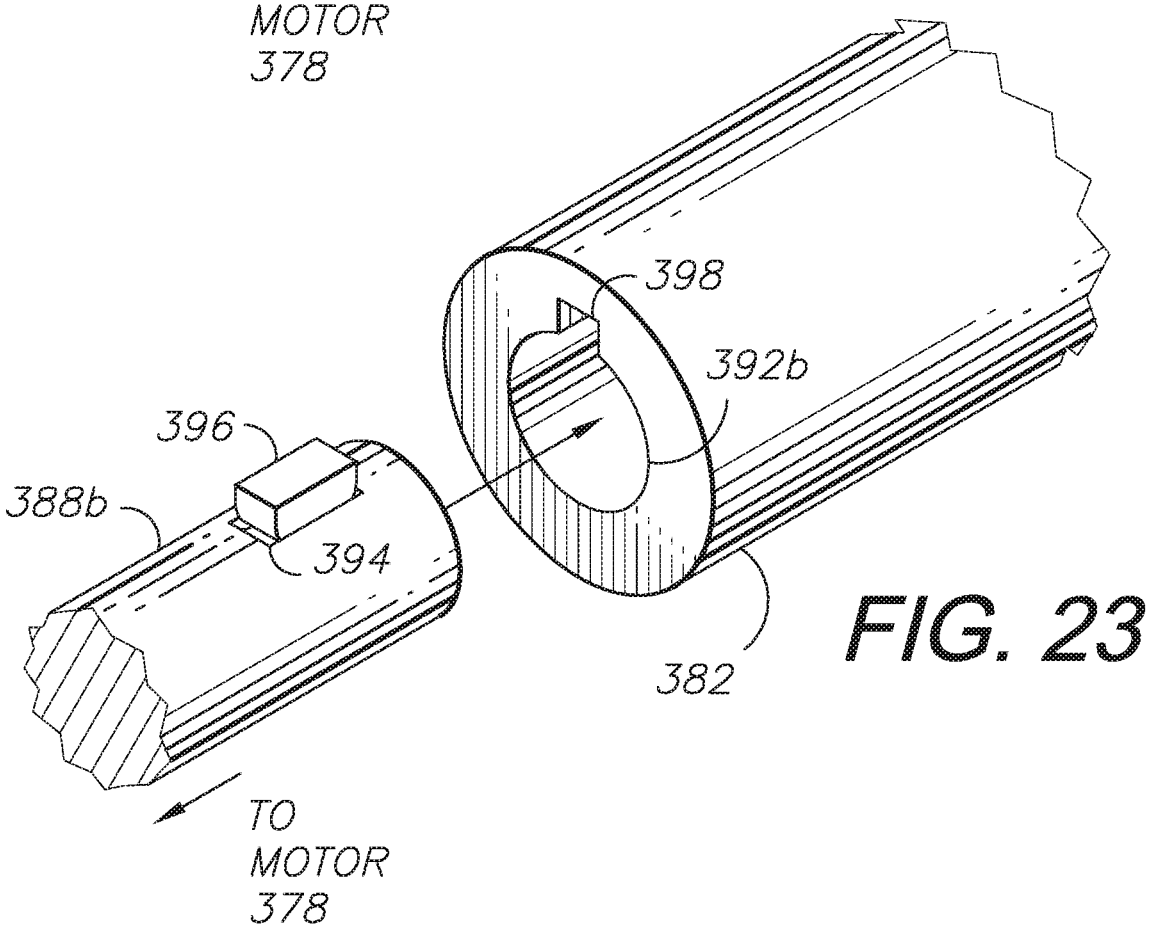
FIG. 23 is a fragmentary, perspective view thereof taken generally in area 22/23 of FIG. 20, particularly showing an alternative connection between the motor shaft and the auger shaft.
Figure 24:
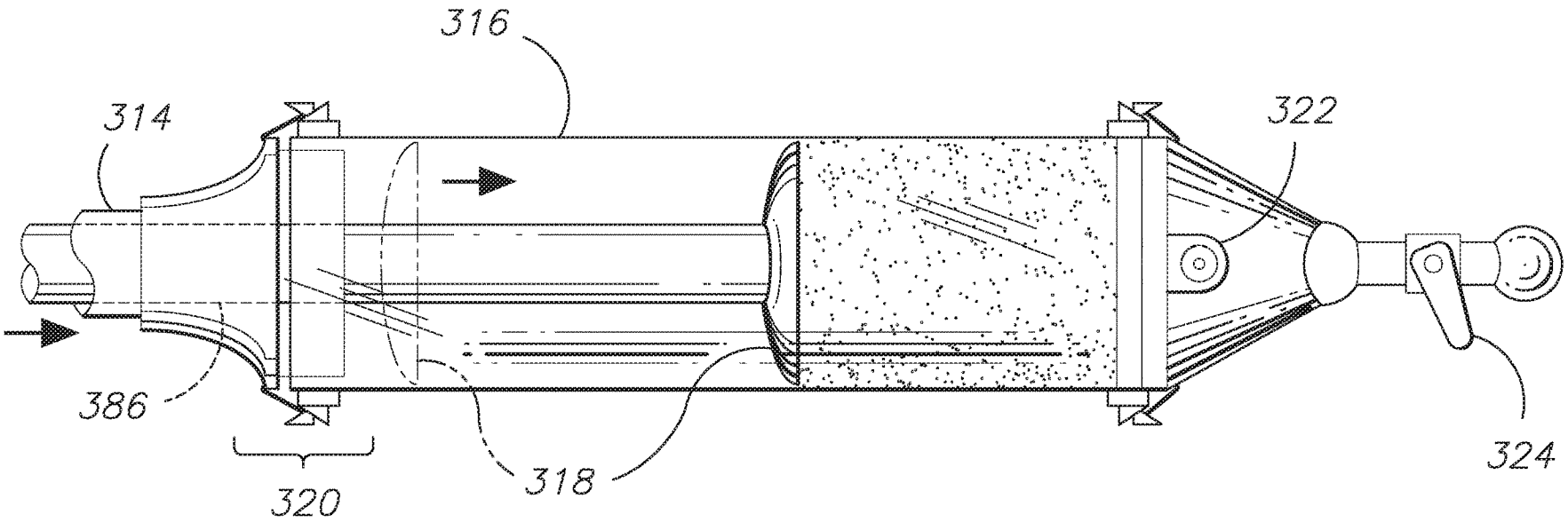
FIG. 24 is an enlarged, view thereof, taken generally in area 24 in FIG. 19.
Figure 25:
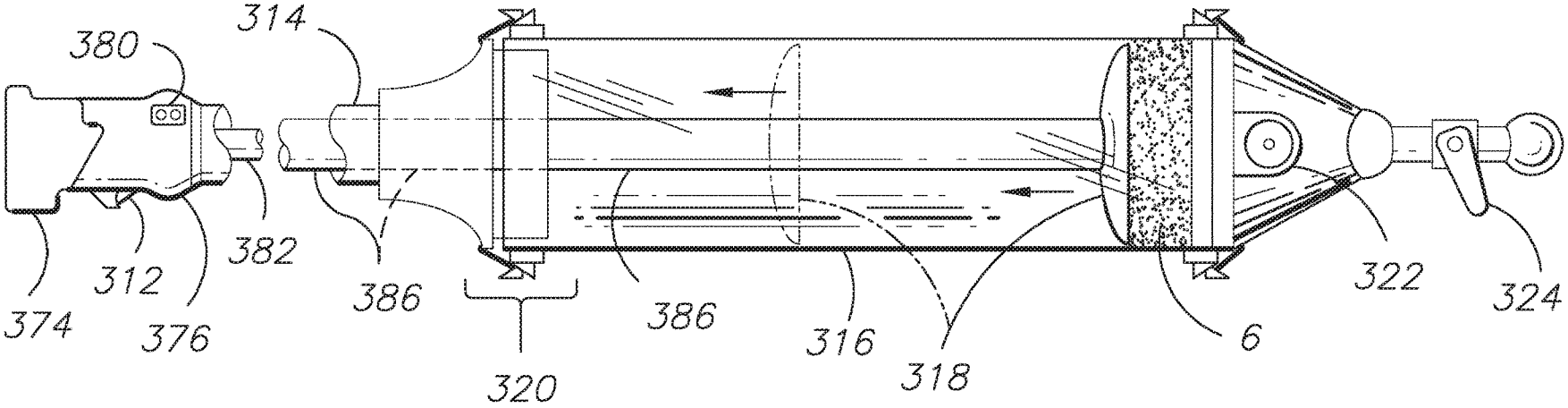
FIG. 25 is an elevational view thereof and including a description of a (re)charging process.
Figure 26:
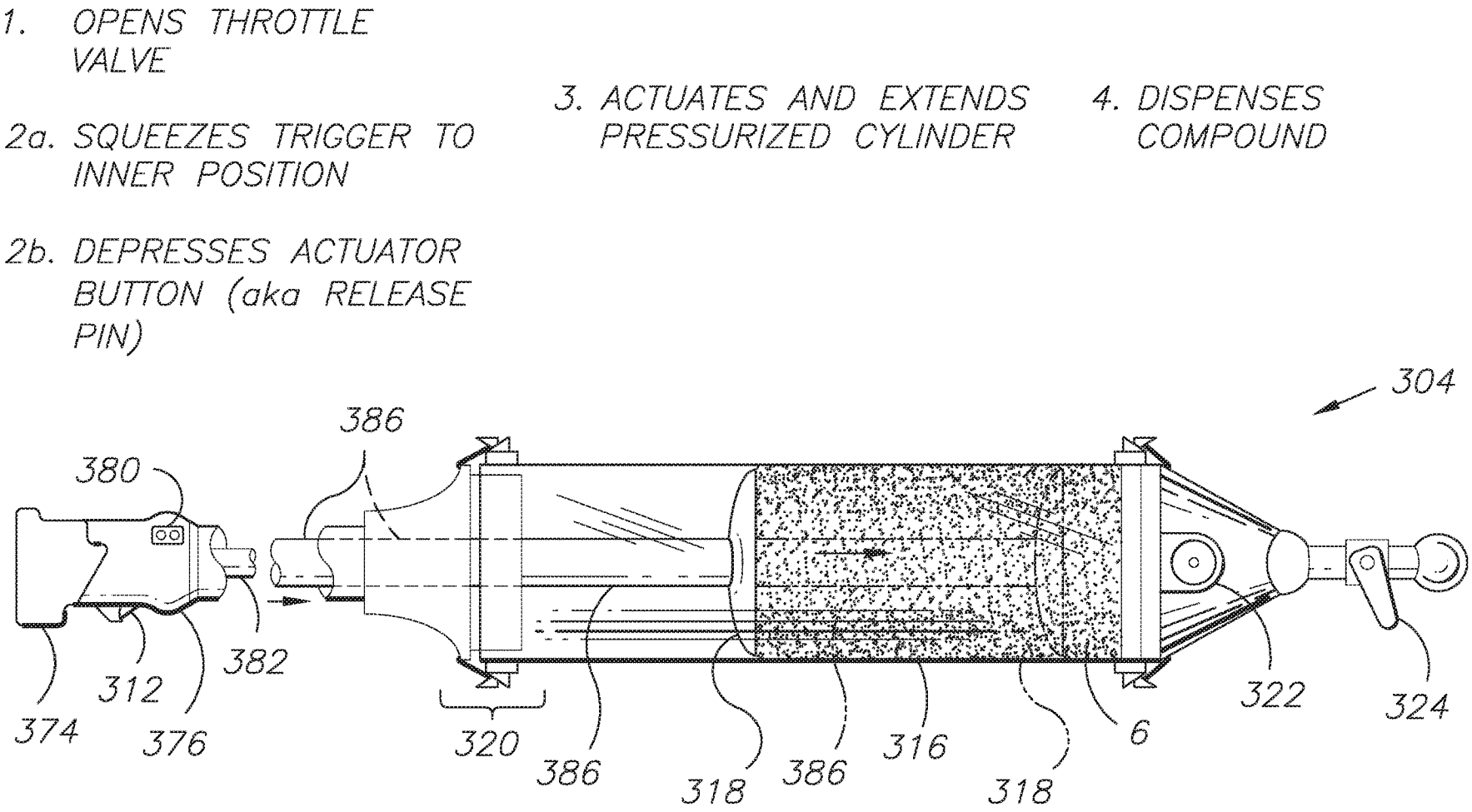
FIG. 26 is a front elevational view thereof and including a description of a dispensing process.

Another embodiment of a potential mating connection between the motor 378 and the auger shaft 382 is shown in FIG. 23. This embodiment of a mating connection employs a keyed motor shaft 388*b* to fit inside a keyed hub 392*b* within the auger shaft. An example key seat 394, key 396, and key way 398 are depicted in FIG. 23. The key arrangement shown is one example of a potential key connection and is not intended to be limiting. Keyed connections including other arrangements thereof are common in the art and should be easily understood by one skilled in the art.

Figure 27:
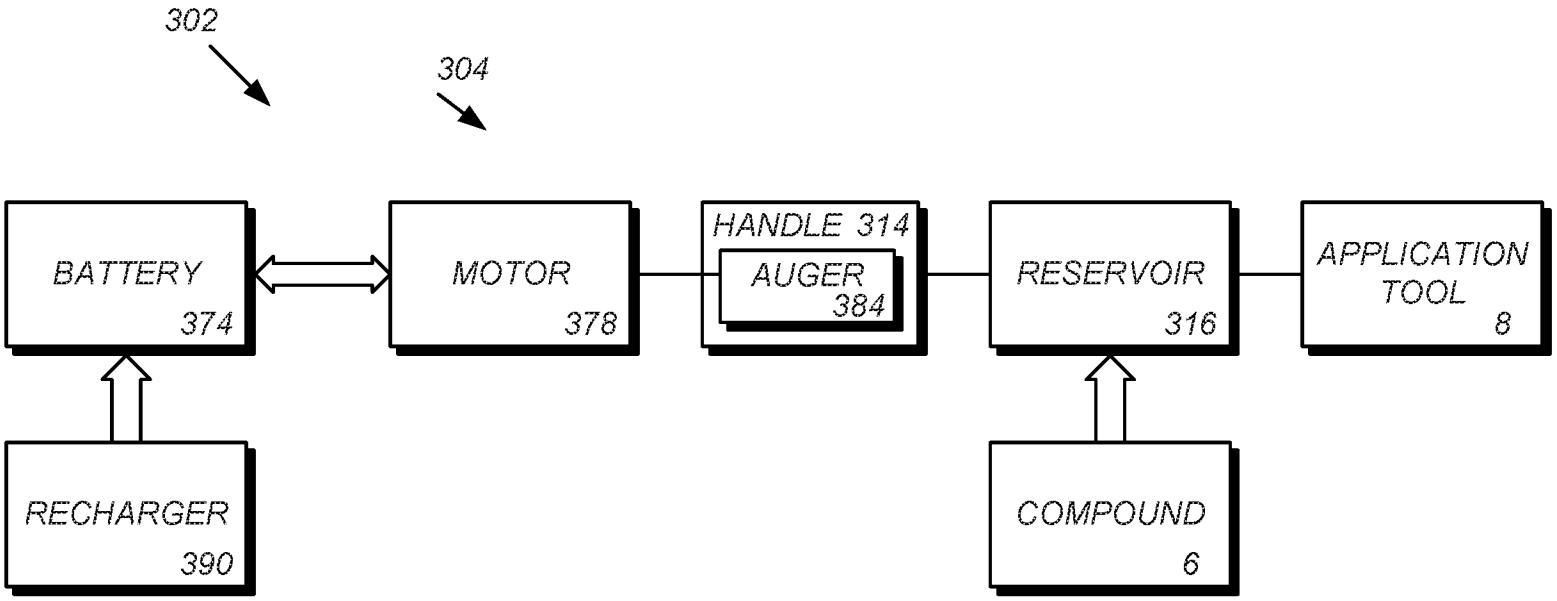
FIG. 27 is a block diagram of a compound application system embodying an aspect of the present invention.

The battery 374 can be recharged by removing it from the assembled tool 304 and connecting it to a charger 390 (FIG. 27).

The system 302 can, similarly to the previous embodiments, incorporate a fill access port 322, a ball valve throttle 324, and one or more openable clamp assemblies 320 to simplify use.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A system for applying a finishing material to a work surface, which system includes:

a handle assembly including a hollow, tubular body with a proximal end, a distal end and a handle bore extending between said ends;

a material reservoir mounted on said distal end of said handle assembly, said reservoir including an interior configured for receiving a quantity of finishing material, an inlet to said interior and an outlet from said interior, said inlet and outlet respectively admitting and discharging material with respect to said reservoir interior;

a discharge mechanism configured for discharging material from said reservoir interior through said outlet;

a finishing tool mounted on said receptacle and configured for receiving material via said outlet and applying material to a work surface;

said discharge mechanism including a rotating threaded rod having a proximal end, a distal end, and an axis of rotation coaxial with said tubular body;

said discharge mechanism further including a plunger in said reservoir connected to said distal end of said threaded rod;

a drive motor mounted on said handle assembly proximal end and drivingly connected to said threaded rod such that rotation of said threaded rod in a first direction extends said plunger in said reservoir and rotation of said threaded rod in a second direction retracts said plunger in said reservoir; and an actuating mechanism mounted on said handle assembly proximal end and configured for causing said drive motor to selectively rotate said threaded rod in said first and second directions.

2. The system according to claim 1 wherein said reservoir includes a swivel connection at said reservoir outlet, said swivel connection mounting said finishing tool and configured for accommodating finishing tool swivel movement relative to said reservoir.

3. The system according to claim 2 wherein said reservoir includes a throttle valve respectively opening and closing said outlet.

4. A system for applying a finishing material to a work surface, which system includes:

a handle assembly including a hollow, tubular body with a proximal end, a distal end and a handle bore extending between said ends;

a material reservoir mounted on said distal end of said handle assembly, said reservoir including an interior configured for receiving a quantity of finishing material, an inlet to said interior and an outlet from said interior, said inlet and outlet respectively admitting and discharging material with respect to said reservoir interior;

a discharge mechanism including a helical rotating element with an axis of rotation coaxial with said tubular body and configured for selectively discharging material through said outlet in a first direction of rotation and reloading said material reservoir in a second direction of rotation;

a finishing tool mounted on said receptacle and configured for receiving material via said outlet and applying material to a work surface;

a drive motor mounted on said handle assembly proximal end and selectively, drivingly connected to said rotating element; and an actuating mechanism mounted on said handle end and configured for causing said drive motor to selectively rotate in said first and second directions of rotation.

5. The system according to claim 4 wherein said rotating element includes an auger rotatably mounted in said handle bore or said reservoir interior.

6. The system according to claim 4, which includes:

said reservoir having a generally tubular configuration with proximal and distal ends;

a plunger in said reservoir and reciprocable between said reservoir proximal and distal ends; and said rotating element comprising a threaded rod threadably connected to said plunger whereby rotating said threaded rod extends and retracts said plunger within said reservoir.

7. The system according to claim 4 wherein said actuating mechanism comprises a switch connected to said motor and including forward/discharge, reverse/reload and off positions.

* * * * *